US009383668B2

(12) United States Patent
Noji et al.

(10) Patent No.: US 9,383,668 B2
(45) Date of Patent: Jul. 5, 2016

(54) TONER

(71) Applicant: CANON KABUSHIKI KAISHA, Tokyo (JP)

(72) Inventors: Shintaro Noji, Mishima (JP); Masatake Tanaka, Yokohama (JP); Naoya Isono, Suntou-gun (JP); Tsutomu Shimano, Mishima (JP); Yu Yoshida, Mishima (JP)

(73) Assignee: CANON KABUSHIKI KAISHA, Tokyo (JP)

( * ) Notice: Subject to any disclaimer, the term of this patent is extended or adjusted under 35 U.S.C. 154(b) by 0 days.

(21) Appl. No.: 14/554,802

(22) Filed: Nov. 26, 2014

(65) Prior Publication Data

US 2015/0153667 A1 Jun. 4, 2015

(30) Foreign Application Priority Data

Nov. 29, 2013 (JP) ..... 2013-247688

(51) Int. Cl.
*G03G 9/087* (2006.01)
*G03G 9/08* (2006.01)

(52) U.S. Cl.
CPC ..... *G03G 9/08711* (2013.01); *G03G 9/0804* (2013.01); *G03G 9/08755* (2013.01); *G03G 9/08782* (2013.01); *G03G 9/08788* (2013.01); *G03G 9/08795* (2013.01); *G03G 9/08797* (2013.01)

(58) Field of Classification Search
CPC ..... G03G 9/08711; G03G 9/08768; G03G 9/08755; G03G 9/08788
USPC ..... 430/109.3, 109.4
See application file for complete search history.

(56) References Cited

U.S. PATENT DOCUMENTS 4,931,375 A * 6/1990 Akimoto ..... G03G 9/08788 430/109.3
4,940,644 A * 7/1990 Matsubara ..... G03G 9/08788 430/109.4
2014/0080050 A1* 3/2014 Asahina ..... G03G 9/0821 430/109.4
2015/0153666 A1* 6/2015 Isono ..... G03G 9/0804 430/109.3

FOREIGN PATENT DOCUMENTS

JP 62-273574 A 11/1987
JP 2012-220569 A 11/2012
JP 2012-247657 A 12/2012
JP 2012-255957 A 12/2012

OTHER PUBLICATIONS

U.S. Appl. No. 14/555,525, filed Nov. 26, 2014. Inventor: Naoya Isono, et al.
U.S. Appl. No. 14/555,536, filed Nov. 26, 2014. Inventor: Tsutomu Shimano, et al.
U.S. Appl. No. 14/555,530, filed Nov. 26, 2014. Inventor: Yu Yoshida, et al.
U.S. Appl. No. 14/554,832, filed Nov. 26, 2014. Inventor: Masatake Tanaka, et al.

* cited by examiner

*Primary Examiner* — Christopher D Rodee
(74) *Attorney, Agent, or Firm* — Fitzpatrick, Cella, Harper and Scinto

(57) ABSTRACT

The present invention relates to a toner including a toner particle containing a binder resin, wherein the binder resin contains a block polymer and a styrene-acrylic resin, the block polymer has a vinyl polymer segment and a polyester segment, the polyester segment has a branch structure and the block polymer has a melting point of 50° C. to 95° C.

10 Claims, No Drawings

TONER

BACKGROUND OF THE INVENTION

1. Field of the Invention

The present invention relates to a toner used for image-forming methods such as an electrophotographic method, an electrostatic recording method and a toner jet method.

2. Description of the Related Art

In recent years, printers and copying machines are required to have high speed and low power consumption, and thus a toner is required to have an improved fixing performance. Specifically there is a requirement for realizing a toner that can be melted rapidly at a lower temperature and thus can be fixed rapidly with low energy and has excellent low-temperature fixability. At the same time, it is also required to realize heat-resistant storability devoid of the change in a toner such as solidification under a possible atmosphere of high temperature during transport of toner cartridges.

In order to meet the requirements, it has been considered to use a resin having a segment capable of forming a crystalline structure (hereinafter referred to as "crystalline resin") as a binder resin. This utilizes a characteristic feature of crystalline resins, that is, a rapid decrease in viscosity at a melting point (sharp melting), thereby allowing a toner that does not change at a desired storage temperature and can be fixed at a low temperature due to sharp melting during fixation. Japanese Patent Application Laid-open Nos. 2012-255957, 2012-247657 and 2012-220569 propose toners containing crystalline polyesters.

However the above-mentioned toners may cause offset phenomenon in which the toner (particularly a crystalline resin having low viscosity) partially adheres to the surface of a fixing member such as a heat roller or a film and then is transferred to a subsequent transfer material. In order to address the problem, Japanese Patent Application Laid-open No. S62-273574 proposes use of crystalline and amorphous block resins as binder resins. This allows a toner to have reduced offsetting to a fixing member and stable fixing performance over a wide temperature range. Another disadvantage of the use of a crystalline resin is deterioration in durability. Crystalline resins generally have regularly-structured molecular arrangements and thus tend to be vulnerable to external force. Therefore the toner containing a crystalline resin in order to realize both low-temperature fixability and heat-resistant storability has problems of easy deterioration and generation of image defects such as streaks during continuous printing.

SUMMARY OF THE INVENTION

An object of the present invention is to provide a toner that can solve the above existing problems.

Specifically an object of the present invention is to provide a toner that can form preferable toner images over a long period of time in spite of inclusion therein of a crystalline resin with the aim of realizing both low-temperature fixability and heat-resistant storability as well as maintaining a wide fixation temperature range.

Thus the present invention is a toner including a toner particle containing a binder resin, wherein the binder resin contains a block polymer and a styrene-acrylic resin;

the block polymer has a vinyl polymer segment and a crystalline polyester segment;

the polyester segment is a segment formed by condensation polymerization of the following (I), (II) and (III):

(I) a dicarboxylic acid having carboxyl groups at both terminals of a linear alkane having 2 to 16 carbon atoms;

(II) a diol having hydroxy groups at both terminals of a linear alkane having 2 to 16 carbon atoms;

(III) an alkane compound having 3 to 24 carbon atoms, or an alkyl ester, lactone or acid anhydride compound derived from the alkane compound;

the alkane compound is at least one compound selected from the group consisting of the following (a) to (f):

(a) a branch alkanedicarboxylic acid;

(b) a branch alkanediol;

(c) a branch alkane monohydroxy monocarboxylic acid;

(d) a linear alkanedicarboxylic acid at least one of carboxyl groups of which is linked to a moiety other than a terminal;

(e) a linear alkanediol at least one of hydroxy groups of which is linked to a moiety other than a terminal;

(f) a linear alkane monohydroxy monocarboxylic acid at least one of carboxyl group and hydroxy group of which is linked to a moiety other than a terminal; and the block polymer has a melting point (Tm) of 50° C. to 95° C.

The present invention is also the toner as described above, wherein the block polymer has a half-width of an endothermic peak, derived from the block polymer, of 4.0° C. to 12.0° C. as observed in differential scanning calorimetric measurement.

The present invention is also the toner as described above, wherein the block polymer has a mass ratio between the vinyl polymer segment and the polyester segment ((mass of the vinyl polymer segment):(mass of the polyester segment)) of 30:70 to 70:30.

The present invention is also the toner as described above, wherein the binder resin contains the block polymer at 6.0% by mass to 50.0% by mass.

The present invention also relates to the toner as described above, wherein the toner particle further contains a wax and satisfy the following formulae (1) and (2):

$$(SPB-1.0)\leq SPC\leq SPB \quad (1)$$

$$(SPW+0.4)\leq SPC \quad (2),$$

where SPB is an SP value of the styrene-acrylic resin; SPC is an SP value of the polyester segment of the block polymer and SPW is an SP value of the wax.

The present invention is also the toner as described above, wherein the vinyl polymer segment has a weight-average molecular weight (Mw) of 4000 to 15000.

According to the present invention, a toner can be provided that can form preferable toner images over a long period of time in spite of inclusion therein of a crystalline resin with the aim of realizing both low-temperature fixability and heat-resistant storability as well as maintaining a wide fixation temperature range.

Further features of the present invention will become apparent from the following description of exemplary embodiments.

DESCRIPTION OF THE EMBODIMENTS

Embodiments of the present invention are hereinafter specifically described.

The present inventors have found that when a block polymer having a branch structure in a polyester segment is used as a second binder resin for toner particle containing a styrene-acrylic resin as a binder resin, a toner can be obtained that has excellent durability while realizing both low-temperature fixability and heat-resistant storability and maintaining a wide fixation temperature range.

Although detailed mechanism has not been revealed, it is assumed that introduction of a branch structure in a polyester segment of a block polymer can suppress excess crystallization of the block polymer, reduce cracking of the toner due to vulnerability of crystalline portions and significantly increase the durability of the toner. Block polymers exhibit crystalline properties due to the regularly arranged linear alkane in polyester segments and it is assumed that external force is focused due to the regular arrangement, resulting in production of vulnerability. It is assumed that when a branch structure is introduced to the polyester segments, crystallization can be inhibited due to steric hindrance of the branch structure and thus the focusing of external force can be alleviated, resulting in reduction in vulnerability against external force. By using the block polymer as a second binder resin, a toner can be obtained that has excellent durability with decreased image defects such as streaks even under severe usage conditions such as continuous printing of a large amount of prints while realizing both low-temperature fixability and heat-resistant storability and maintaining a wide fixation temperature range.

A first binder resin used in the present invention is a styrene-acrylic resin. It is assumed that by using a styrene-acrylic resin as a first binder resin, unnecessary compatibility during production of a toner can be suppressed and compatibility and reduction in the glass transition temperature and hence deterioration in heat-resistant storability can be suppressed. It is further assumed that by using a styrene-acrylic resin, the viscosity of a molten toner can be maintained, and thus a toner having a wide fixation temperature range can be provided.

A second binder resin used in the present invention is a block polymer. The block polymer is required to have a vinyl polymer segment and a crystalline polyester segment. The term "crystalline" means the presence of a melting point in the DSC measurement.

It is assumed that a block polymer having a vinyl polymer segment can maintain the viscosity even after melting, and thus a toner can be obtained that can suppress offsetting and has a wide fixation temperature range. It is also assumed that because the vinyl polymer segment and the first binder resin have similar SP values, the vinyl polymer segment can be an origin of compatibility during fixation, instantaneously reducing the viscosity of the styrene-acrylic resin.

The polyester segment is produced from an alkanedicarboxylic acid having carboxyl groups at both terminals of a linear alkane having 2 to 16 carbon atoms, an alkanediol having hydroxy groups at both terminals of a linear alkane having 2 to 16 carbon atoms and an alkane compound having 3 to 24 carbon atoms that generates a branch alkyl group in the polyester segment upon production of the polyester. Condensation polymerization of the compounds allows formation of the polyester segment.

Examples of the alkanedicarboxylic acid include alkanedicarboxylic acids represented by the formula (3):

$$HOOC—(CH_2)_m—COOH \quad \text{Formula(3)}$$

[wherein m is an integer of 2 to 16 (preferably 6 to 10)] such as succinic acid, glutaric acid, adipic acid, sebacic acid, dodecanedioic acid, tetradecanedioic acid, hexadecanedioic acid and octadecanedioic acid.

Examples of the alkanediol include alkanediols represented by the formula (4):

$$HO—(CH_2)_n—OH \quad \text{Formula(4)}$$

[wherein n is an integer of 2 to 16 (preferably 6 to 12)] such as 1,3-propanediol, 1,4-butanediol, 1,5-pentanediol, 1,6-hexanediol, 1,10-decanediol, 1,12-dodecanediol, 1,14-tetradecanediol and 1,16-hexadecanediol.

The alkane compound having 3 to 24 (preferably 5 to 22) carbon atoms is selected from the following (a) to (f):

(a) a branch alkanedicarboxylic acid;

(b) a branch alkanediol;

(c) a branch alkane monohydroxy monocarboxylic acid;

(d) a linear alkanedicarboxylic acid at least one of carboxyl groups of which is linked to a moiety other than a terminal;

(e) a linear alkanediol at least one of hydroxy groups of which is linked to a moiety other than a terminal;

(f) a linear alkane monohydroxy monocarboxylic acid at least one of carboxyl group and hydroxy group of which is linked to a moiety other than a terminal.

The alkane compound is a monomer that can introduce a branch structure in a polyester.

Examples of the branch alkanedicarboxylic acid (a) include dimethylmalonic acid, isopropylmalonic acid, diethylmalonic acid, 1-methylbutylmalonic acid, dipropylmalonic acid, diisobutylmalonic acid and the like.

Examples of the branch alkanediol (b) include 3-methyl-1,3-butanediol, neopentyl glycol, pinacol, 2-ethyl-1,3-hexanediol, 2,2,4-trimethyl-1,3-pentanediol, 3,5-dimethyl-2,4-docosanediol and the like.

Examples of the branch alkane monohydroxy monocarboxylic acid (c) include hydroxypivalic acid, 3-hydroxy-3,4,4-trimethylpentanoic acid, 2-hydroxy-4,6,6-trimethylheptanoic acid, 3-hydroxy-15-methylhexadecanoic acid and the like.

Examples of the linear alkanedicarboxylic acid (d) include methylmalonic acid, 2-propylmalonic acid, 2-pentylmalonic acid, 2-heptylmalonic acid, 2-decylmalonic acid, 2-dodecylmalonic acid, dodecylsuccinic acid, 2-tetradecylmalonic acid, 2-cetylmalonic acid, 9-carboxystearic acid, 2-octadecylmalonic acid, octadecylsuccinic acid and the like.

Examples of the linear alkanediol (e) include 1,2-propanediol, 1,2-butanediol, 1,3-butanediol, 1,2-pentanediol, 1,2-hexanediol, 1,2-heptanediol, 1,2-octanediol, 1,2-nonanediol, 1,2-decanediol, 1,2-dodecanediol, 1,2-tetradecanediol, 1,2-hexadecanediol, 1,2-octadecanediol, 1,2-eicosanediol, 1,2-docosanediol, 1,2-tetracosanediol and the like.

Examples of the linear alkane monohydroxy monocarboxylic acid (f) include 2-hydroxyisobutyric acid, 2-hydroxy-2-methylbutyric acid, 2-hydroxyoctanoic acid, 4-hydroxydecanoic acid, 3-hydroxymyristic acid, 2-hydroxypalmitic acid, 12-hydroxystearic acid and the like.

The alkane compound may be the one in which a carboxyl group is converted to an (preferably C1-4) alkyl ester compound (including lactone) or to an acid anhydride compound, as far as the compound can generate the same partial skeleton in the polyester. For example, dodecylsuccinic acid used may be in the form of dimethyl dodecylsuccinate or dodecylsuccinic anhydride. 4-hydroxydecanoic acid used may be in the form of methyl 4-hydroxydecanoate or γ-decanolactone.

It is assumed that introduction of a branch structure in a polyester segment by the alkane compound alleviates focusing of external force to the crystalline portion, and thus a toner can be obtained that has high durability with decreased image defects such as streaks even under severe usage conditions.

Further, the block polymer used in the present invention is required to have a melting point (Tm) of 50° C. to 95° C. When the melting point is lower than 50° C., blocking is caused and thus it is difficult to use the block polymer in view of the storability. When the melting point is higher than 95° C., higher temperature is required for melting the block polymer and thus it is difficult to use the block polymer in view of the low-temperature fixability. The melting point is more preferably 60° C. to 85° C.

The melting point of the block polymer can be adjusted by a monomer used for production of the polyester segment or the ratio between the polyester segment and the vinyl polymer segment.

The block polymer used in the present invention preferably has a half-width of an endothermic peak derived from the block polymer of 4.0° C. to 12.0° C. and more preferably 5.0° C. to 12.0° C. as observed in differential scanning calorimetric measurement. The endothermic peak is observed during melting of the block polymer and it is assumed that the half-width of the peak is strongly correlated with the degree of crystallinity of the block polymer. When the half-width is within the above-mentioned range, a toner can be obtained that has improved durability, has both low-temperature fixability and heat resistance and further has a wide fixation temperature range at a high level. The half-width can be controlled by the amount of the alkane compound included. The molar content of the alkane compound is preferably 1.0 mol % to 20.0 mol %.

The block polymer preferably has a mass ratio between the vinyl polymer segment and the polyester segment in the block polymer ((mass of the vinyl polymer segment):(mass of the polyester segment)) of 30:70 to 80:20, more preferably 30:70 to 70:30 and still more preferably 35:65 to 60:40. It is assumed that when the mass ratio between the vinyl polymer segment and the polyester segment is within the above range, characteristic properties of the vinyl polymer segment and the polyester segment can be efficiently exploited and a toner can be obtained that has both low-temperature fixability and heat resistance and further has a wide fixation temperature range at a high level.

The amount of the block polymer in the binder resin is preferably 2.0% by mass to 50.0% by mass, more preferably 6.0% by mass to 50.0% by mass, still more preferably 10.0% by mass to 45.0% by mass and still more preferably 20.0% by mass to 40.0% by mass. When the amount of the block polymer is within the above-mentioned range, it is assumed that the sharp melt property of the block polymer can be fully exploited and charge leakage caused by the crystalline resin can be suppressed, and thus a toner can be obtained that has preferably low-temperature fixability and charging performance.

It is preferable that the solubility parameter (SP) of the polyester segment, referred to as SPC, satisfies the following formulae (1) and (2):

$$(SPB-1.0) \leq SPC \leq SPB \quad (1)$$

$$(SPW+0.4) \leq SPC \quad (2),$$

wherein SPB is an SP value of the styrene-acrylic resin and SPW is an SP value of a wax. It is assumed that when the SPC satisfies the formula (1), unnecessary plasticization during production of the toner can be suppressed and sufficient compatibility can be obtained at the time of melting, and thus a toner can be obtained that has both low-temperature fixability and heat resistance at high levels. It is assumed that when the SPC satisfies the formula (2), compatibility of the block polymer with the wax during fixation can be suppressed, and thus a toner can be obtained that has a wide fixation temperature range without impairing releasability of the wax. The formula (1) is more preferably (SPB−0.5)≤SPC≤SPB. The formula (2) is more preferably (SPW+0.8)≤SPC.

The SP value can be adjusted by the species and amount of the monomers added. In order to increase the SP value, a monomer having an increased SP value may be added, for example. On the other hand, in order to decrease the SP value, a monomer having a decreased SP value may be added, for example.

The vinyl polymer segment preferably has a weight-average molecular weight (Mw) of 4000 to 15000 and more preferably 6000 to 14000. It is assumed that when the vinyl polymer segment has a Mw within the above-mentioned range, both effects of sharp melt property of the polyester segment and of the vinyl polymer segment that serves as an origin of compatibility can be obtained. The weight-average molecular weight (Mw) can be controlled by polymerization reaction conditions for production of the vinyl polymer segment (the amount of the initiator, the timing of addition of the initiator, reaction temperature and the like).

Known vinyl monomers may be used for the vinyl polymer segment. Specific examples of the vinyl monomer include styrene, methyl methacrylate, n-butyl acrylate and the like. Among these, styrene is particularly preferred because it is assumed that styrene can efficiently act as a segment for generating compatibility with the styrene-acrylic resin, exhibiting more plasticization effect during melting.

The block polymer as a whole preferably has a weight-average molecular weight of, in view of the compatibility with the styrene-acrylic resin, the heat-resistant storability of the toner and deterioration during the durability test of the toner, 15000 to 40000 and more preferably 20000 to 40000.

A block polymer is defined as a polymer which is composed of multiple blocks in linear sequence ("Glossary of Basic Terms in Polymer Science", The International Union of Pure and Applied Chemistry, The Society of Polymer Science, Japan). This definition also applies herein.

A polymerizable monomer used for producing the styrene-acrylic resin may be a vinyl polymerizable monomer which allows radical polymerization. The vinyl polymerizable monomer used may be a monofunctional polymerizable monomer or a polyfunctional polymerizable monomer.

Examples of the monofunctional polymerizable monomer include styrene derivatives such as styrene, α-methylstyrene, β-methylstyrene, o-methylstyrene, m-methylstyrene, p-methylstyrene, 2,4-dimethylstyrene, p-n-butylstyrene, p-tert-butylstyrene, p-n-hexylstyrene, p-n-octylstyrene, p-n-nonylstyrene, p-n-decylstyrene, p-n-dodecylstyrene, p-methoxystyrene and p-phenylstyrene;

acrylic polymerizable monomers such as methyl acrylate, ethyl acrylate, n-propyl acrylate, iso-propyl acrylate, n-butyl acrylate, iso-butyl acrylate, tert-butyl acrylate, n-amyl acrylate, n-hexyl acrylate, 2-ethylhexyl acrylate, n-octyl acrylate, n-nonyl acrylate, cyclohexyl acrylate, benzyl acrylate, (dimethyl phosphate)ethyl acrylate, (diethyl phosphate)ethyl acrylate, (dibutyl phosphate)ethyl acrylate and (2-benzoyloxy)ethyl acrylate; and methacrylate polymerizable monomers such as methyl methacrylate, ethyl methacrylate, n-propyl methacrylate, iso-propyl methacrylate, n-butyl methacrylate, iso-butyl methacrylate, tert-butyl methacrylate, n-amyl methacrylate, n-hexyl methacrylate, 2-ethylhexyl methacrylate, n-octyl methacrylate, n-nonyl methacrylate, (diethyl phosphate) ethyl methacrylate and (dibutyl phosphate)ethyl methacrylate.

Examples of the polyfunctional polymerizable monomer include diethylene glycol diacrylate, triethylene glycol diacrylate, tetraethylene glycol diacrylate, polyethylene glycol diacrylate, 1,6-hexanediol diacrylate, neopentyl glycol diacrylate, tripropylene glycol diacrylate, polypropylene glycol diacrylate, 2,2'-bis(4-(acryloxy diethoxy)phenyl)propane, trimethylolpropane triacrylate, tetramethylolmethane tetraacrylate, ethylene glycol dimethacrylate, diethylene glycol dimethacrylate, triethylene glycol dimethacrylate, tetraethylene glycol dimethacrylate, polyethylene glycol dimethacrylate, 1,3-butylene glycol dimethacrylate, 1,6-hexanediol dimethacrylate, neopentyl glycol dimethacrylate, polypropylene glycol dimethacrylate, 2,2'-bis(4-(methacryloxy diethoxy)phenyl)propane, 2,2'-bis(4-(methacryloxy polyethoxy)phenyl)propane, trimethylolpropane trimethacrylate, tetramethylolmethane tetramethacrylate, divinylbenzene, divinylnaphthalene and divinyl ether.

The monofunctional polymerizable monomers are used independently, or two or more kinds thereof are used in combination, or the monofunctional polymerizable monomer and the polyfunctional polymerizable monomer are used in combination, or the polyfunctional polymerizable monomers are used independently, or two or more kinds thereof are used in combination. Among the polymerizable monomers, it is preferable that styrene or styrene derivatives are used independently or two or more kinds thereof are used in a mixture or styrene or styrene derivatives are used in a mixture with another polymerizable monomer, in view of the developing characteristic and durability of the toner.

The toner particle according to the present invention may be produced by any production method such as an emulsion polymerization method, a suspension granulation method, a dissolution suspension method or a melt kneading method. It is preferable, however, that the toner particle is produced by the method in which a polymerizable monomer composition is polymerized in an aqueous medium such as a suspension polymerization method, an emulsion polymerization method or a dissolution suspension method.

Production of the toner particles is described hereinbelow by referring to the suspension polymerization method which is the most suitable production method of the toner particle used in the present invention.

The polymerizable monomer for production of the styrene-acrylic resin, the specific block polymer and an optional additive such as a colorant and a wax are homogeneously dissolved or dispersed by means of a disperser such as a homogenizer, a ball mill, a colloid mill or an ultrasonic disperser. A polymerization initiator is dissolved therein to prepare a polymerizable monomer composition. The polymerizable monomer composition is then suspended in an aqueous medium containing a dispersion stabilizer to carry out polymerization, thereby producing the toner particle.

The polymerization initiator may be added at the same time as addition of a different additive to the polymerizable monomer, or may be added immediately before suspension into the aqueous medium. Alternatively, the polymerization initiator which is dissolved in the polymerizable monomer or a solvent may be added immediately after granulation and before initiation of polymerization reaction.

In case of the polymerization using an aqueous medium such as a suspension polymerization method, it is preferable that a polar resin is added to the above-mentioned mixed solution. Addition of the polar resin may promote encapsulation of the block polymer and the wax.

When a polymerizable monomer composition suspended in an aqueous medium contains the polar resin, the polar resin tends to move towards the vicinity of the interface between the aqueous medium and the polymerizable monomer composition due to the difference in the affinity towards water and thus the polar resin is unevenly distributed on the surface of the toner particle. As a result, the toner particle has a core-shell structure.

When the polar resin used for a shell has high melting point, blocking during storage of the toner can be suppressed even when the binder resin is designed to melt at a low temperature with the aim of fixation at a low temperature.

The polar resin is preferably a polyester resin or a carboxyl-containing styrene resin. By using a polyester resin or a carboxyl-containing styrene resin as the polar resin, the resin may be able to exhibit the lubricity which is inherent to the resin when the resin is unevenly distributed on the surface of the toner particle to form a shell.

The polyester resin used may be a resin obtained by condensation polymerization of an acid component monomer and an alcohol component monomer mentioned hereinbelow. Examples of the acid component monomer include terephthalic acid, isophthalic acid, phthalic acid, fumaric acid, maleic acid, malonic acid, succinic acid, glutaric acid, adipic acid, pimelic acid, suberic acid, azelaic acid, sebacic acid, camphoric acid, cyclohexanedicarboxylic acid and trimellitic acid.

Examples of the alcohol component monomer include alkylene glycols and polyalkylene glycols such as ethylene glycol, diethylene glycol, triethylene glycol, 1,2-propylene glycol, 1,3-propylene glycol, 1,4-butanediol, neopentyl glycol and 1,4-bis(hydroxymethyl)cyclohexane, bisphenol A, hydrogenated bisphenol, ethylene oxide adducts of bisphenol A, propylene oxide adducts of bisphenol A, glycerine, trimethylolpropane and pentaerythritol.

The carboxyl group-containing styrene resin is preferably a styrene-acrylic acid copolymer, a styrene-methacrylic acid copolymer, a styrene-maleic acid copolymer or the like and is particularly preferably a styrene-acrylic ester-acrylic acid copolymer because the charge amount can be easily controlled. The polar resin more preferably contains a monomer having a primary or secondary hydroxy group. Specific examples of a polymer composition include styrene-2-hydroxyethyl methacrylate-methacrylic acid-methyl methacrylate copolymers, styrene-n-butyl acrylate-2-hydroxyethyl methacrylate-methacrylic acid-methyl methacrylate copolymers, styrene-α-methylstyrene-2-hydroxyethyl methacrylate-methacrylic acid-methyl methacrylate copolymers and the like. The resin containing a monomer having a primary or secondary hydroxy group has high polarity and more preferable long-term standing stability.

The amount of the polar resin relative to 100.0 parts by mass of the binder resin (the styrene-acrylic resin (or the polymerizable monomer for production of the styrene-acrylic resin) and the block polymer) is preferably 1.0 part by mass to 20.0 parts by mass and more preferably 2.0 parts by mass to 10.0 parts by mass.

The toner of the present invention preferably contains a wax in order to confer releasability.

The toner containing a wax can sufficiently exhibit releasability and can have an extended fixation temperature range. The wax which may be used in the present invention may be a well known wax component. Specific examples thereof include petroleum-derived waxes and derivatives thereof such as paraffin wax, microcrystalline wax and petrolatum, montan wax and derivatives thereof, hydrocarbon waxes according to the Fischer-Tropsch process and derivatives thereof, polyolefin waxes and derivatives thereof typically including polyethylene, natural waxes and derivatives thereof such as carnauba wax and candelilla wax, the derivatives including oxides, block copolymers with vinyl monomers and graft modification products. Mention may also be made on alcohols such as higher aliphatic alcohols; fatty acids such as stearic acid and palmitic acid, and acid amides, esters and ketones thereof; hydrogenated castor oil and derivatives thereof, vegetable waxes and animal waxes. The waxes may be used independently or two or more kinds may be used in combination.

Among these, when a polyolefin, a hydrocarbon wax according to the Fischer-Tropsch process or a petroleum-derived wax is used, the image developing ability and the transferability can be further improved. The wax component may contain an antioxidant at the range that does not affect the charging performance of the toner. The wax component is preferably used at, relative to 100.0 parts by mass of the binder resin, 1.0 part by mass to 30.0 parts by mass.

The wax component used in the present invention preferably has a melting point of 30° C. to 120° C. and more preferably 60° C. to 100° C.

As described above, the wax preferably has an SP value (SPW) that is lower by 0.4 or more than the SP value (SPC) of the polyester segment of the block polymer.

By using the wax component having the thermal properties as described above, not only preferable fixing performance of the resulting toner but also releasing effect due to the wax component is efficiently exhibited and a sufficient fixation range is ensured.

In the present invention, a colorant may be used that may be an organic pigment, an organic dye or an inorganic pigment described hereinbelow.

Examples of a cyan colorant include copper phthalocyanine compounds and derivatives thereof, anthraquinone compounds and basic dye lake compounds. Specific examples thereof include the followings: C.I. pigment blue 1, C.I. pigment blue 7, C.I. pigment blue 15, C.I. pigment blue 15:1, C.I. pigment blue 15:2, C.I. pigment blue 15:3, C.I. pigment blue 15:4, C.I. pigment blue 60, C.I. pigment blue 62 and C.I. pigment blue 66.

Examples of a magenta colorant include the followings: condensed azo compounds, diketopyrrolopyrrole compounds, anthraquinones, quinacridone compounds, base dye lake compounds, naphthol compounds, benzimidazolone compounds, thioindigo compounds and perylene compounds. Specific examples thereof include the followings: C.I. pigment red 2, C.I. pigment red 3, C.I. pigment red 5, C.I. pigment red 6, C.I. pigment red 7, C.I. pigment violet 19, C.I. pigment red 23, C.I. pigment red 48:2, C.I. pigment red 48:3, C.I. pigment red 48:4, C.I. pigment red 57:1, C.I. pigment red 81:1, C.I. pigment red 122, C.I. pigment red 144, C.I. pigment red 146, C.I. pigment red 150, C.I. pigment red 166, C.I. pigment red 169, C.I. pigment red 177, C.I. pigment red 184, C.I. pigment red 185, C.I. pigment red 202, C.I. pigment red 206, C.I. pigment red 220, C.I. pigment red 221 and C.I. pigment red 254.

Examples of a yellow colorant include condensed azo compounds, isoindolinone compounds, anthraquinone compounds, azo-metal complexes, methine compounds and allylamide compounds. Specific examples thereof include the followings: C.I. pigment yellow 12, C.I. pigment yellow 13, C.I. pigment yellow 14, C.I. pigment yellow 15, C.I. pigment yellow 17, C.I. pigment yellow 62, C.I. pigment yellow 74, C.I. pigment yellow 83, C.I. pigment yellow 93, C.I. pigment yellow 94, C.I. pigment yellow 95, C.I. pigment yellow 97, C.I. pigment yellow 109, C.I. pigment yellow 110, C.I. pigment yellow 111, C.I. pigment yellow 120, C.I. pigment yellow 127, C.I. pigment yellow 128, C.I. pigment yellow 129, C.I. pigment yellow 147, C.I. pigment yellow 151, C.I. pigment yellow 154, C.I. pigment yellow 155, C.I. pigment yellow 168, C.I. pigment yellow 174, C.I. pigment yellow 175, C.I. pigment yellow 176, C.I. pigment yellow 180, C.I. pigment yellow 181, C.I. pigment yellow 185, C.I. pigment yellow 191 and C.I. pigment yellow 194.

Examples of a black colorant include carbon black and black colorants obtained by toning a yellow colorant, a magenta colorant and a cyan colorant as described.

The colorants may be used independently, or may be used in a mixture, or may be used in the form of solid solution. The colorant used in the present invention is selected in view of the hue angle, chroma, lightness, lightfastness, OHP transparency and dispersibility in the toner particle.

The colorant is preferably used at, relative to 100.0 parts by mass of the binder resin, 1.0 part by mass to 20.0 parts by mass.

When a toner particle is prepared by a suspension polymerization method, it is preferable to use a colorant obtained after hydrophobic treatment using a substance that does not inhibit polymerization, in view of an inhibitory effect on polymerization or a transfer ability to an aqueous phase of the colorant.

Hydrophobic treatment of dyes is preferably carried out by polymerizing in advance the polymerizable monomer in the presence of the dye to give a coloured polymer, which is then added to a polymerizable monomer composition.

Carbon black may be treated in the same hydrophobic treatment manner as for the above dyes or with a substance (polyorganosiloxane) that reacts with a surface functional group of carbon black.

Optionally a charge control agent may be used. Well known charge control agents may be used. A particularly preferable charge control agent is the one that has high triboelectric charging speed and can stably maintain a certain triboelectric charge quantity. When a toner particle is prepared by a suspension polymerization method, the charge control agent is particularly preferable that has a low inhibitory effect on polymerization and is substantially devoid of a soluble component in an aqueous medium.

Charge control agents include those conferring negative chargeability and conferring positive chargeability on the toner. Examples of the charge control agent conferring negative chargeability on the toner include the following: monoazo metal compounds, acetylacetone metal compounds, aromatic oxycarboxylic acid-, aromatic dicarboxylic acid-, oxycarboxylic acid- and dicarboxylic acid-based metal compounds, aromatic oxycarboxylic acids, aromatic mono- and poly-carboxylic acids and metal salts, anhydrides and esters thereof, phenol derivatives such as bisphenol, urea derivatives, metal-containing salicylic acid compounds, metal-containing naphthoic acid compounds, boron compounds, quaternary ammonium salts, calixarenes and charge control resins.

Examples of the charge control agent conferring positive chargeability on the toner include the followings: guanidine compounds; imidazole compounds; quaternary ammonium salts such as tributylbenzylammonium-1-hydroxy-4-naphthosulphonate and tetrabutylammonium tetrafluoroborate and analogues thereof, i.e., onium salts such as phosphonium salts and lake pigments thereof; triphenylmethane dyes and lake pigments thereof (a laking agent may be phosphotungstic acid, phosphomolybdic acid, phosphotungstomolybdic acid, tannic acid, lauric acid, gallic acid, a ferricyanide and a ferrocyanide); metal salts of higher fatty acids; and charge control resins.

The charge control agents may be added independently or two or more kinds may be added in combination.

Among the charge control agents, a metal-containing salicylic acid compound is preferred and the one in which the metal is aluminium or zirconium is more preferred.

The amount of the charge control agent added is, relative to 100.0 parts by mass of the binder resin, preferably 0.01 parts by mass to 20.0 parts by mass and more preferably 0.5 parts by mass to 10.0 parts by mass.

The charge control resin is preferably a polymer or copolymer having a sulphonic acid group, a sulphonate salt group or a sulphonate ester group. Specifically, the polymer having a sulphonic acid group, a sulphonate salt group or a sulphonate ester group preferably contains a sulphonic acid group-containing acrylamide monomer or a sulphonic acid group-containing methacrylamide monomer at a copolymerization ratio of 2% by mass or more and more preferably 5% by mass or more. The charge control resin preferably has a glass transition temperature (Tg) of 35 to 90° C., a peak molecular weight (Mp) of 10,000 to 30,000 and a weight-average molecular weight (Mn) of 25,000 to 50,000. Such a charge control resin can confer preferable triboelectric charging characteristics without affecting thermal properties required for toner particles. The charge control resin, as it contains a sulphonic acid group, has improved dispersibility in a colorant-dispersed solution as well as confers improved dispersibility on a colorant, thereby allowing further improvements in the tinting strength, transparency and triboelectric charging characteristics.

A polymerization initiator may be used for polymerization of the polymerizable monomer. The polymerization initiator that can be used in the present invention includes organic peroxide initiators and azo polymerization initiators. Examples of the organic peroxide initiator include the followings: benzoyl peroxide, lauroyl peroxide, di-α-cumyl peroxide, 2,5-dimethyl-2,5-bis(benzoylperoxy)hexane, bis(4-t-butylcyclohexyl)peroxy dicarbonate, 1,1-bis(t-butylperoxy) cyclododecane, t-butylperoxymaleic acid, bis(t-butylperoxy) isophthalate, methyl ethyl ketone peroxide, tert-butylperoxy-2-ethylhexanoate, diisopropyl peroxycarbonate, cumene hydroperoxide, 2,4-dichlorobenzoyl peroxide and tert-butylperoxypivalate.

Examples of the azo polymerization initiator include 2,2'-azobis-(2,4-dimethylvaleronitrile), 2,2'-azobisisobutyronitrile, 1,1'-azobis(cyclohexane-1-carbonitrile), 2,2'-azobis-4-methoxy-2,4-dimethylvaleronitrile and azobis methylbutyronitrile and the like.

The polymerization initiator may be a redox initiator which is a combination of an oxidizing substance and a reducing substance. Examples of the oxidizing substance include inorganic peroxides such as hydrogen peroxide and persulphates (sodium salt, potassium salt and ammonium salt) and oxidizing metal salts such as tetravalent cerium salts. Examples of the reducing substance include reducing metal salts (divalent iron salts, monovalent copper salts and trivalent chrome salts), amino compounds such as ammonia, lower amines (amines having about 1 to 6 carbon atoms such as methylamine and ethylamine) and hydroxylamine, reducing sulphur compounds such as sodium thiosulphate, sodium hydrosulphite, sodium hydrogen sulphite, sodium sulphite and sodium formaldehyde sulphoxylate, lower alcohols (1 to 6 carbon atoms), ascorbic acid or salts thereof and lower aldehydes (1 to 6 carbon atoms).

The polymerization initiator may be selected according to the 10-hour half-life decomposition temperature. The above polymerization initiators may be used independently or two or more kinds may be used in a mixture. The amount of the polymerization initiator may vary depending on a desired degree of polymerization, and is generally, relative to 100.0 parts by mass of the polymerizable monomer, 0.5 parts by mass to 20.0 parts by mass.

In order to control the degree of polymerization, a well known chain transfer agent and polymerization inhibitor may be added.

A variety of crosslinking agents may be used during polymerization of the polymerizable monomer. Examples of the crosslinking agent include polyfunctional compounds such as divinylbenzene, 4,4'-divinylbiphenyl, ethylene glycol diacrylate, ethylene glycol dimethacrylate, diethylene glycol diacrylate, diethylene glycol dimethacrylate, glycidyl acrylate, glycidyl methacrylate, trimethylolpropane triacrylate and trimethylolpropane trimethacrylate.

A dispersion stabilizer that may be used upon preparation of an aqueous medium may be any well known inorganic dispersion stabilizer or organic dispersion stabilizer. Examples of the inorganic dispersion stabilizer include tricalcium phosphate, magnesium phosphate, aluminium phosphate, zinc phosphate, calcium carbonate, magnesium carbonate, calcium hydroxide, magnesium hydroxide, aluminium hydroxide, calcium metasilicate, calcium sulphate, barium sulphate, bentonite, silica and alumina. Examples of organic dispersion stabilizer include, on the other hand, polyvinyl alcohol, gelatine, methylcellulose, methylhydroxypropylcellulose, ethylcellulose, carboxymethylcellulose sodium salt, polyacrylic acid and salts thereof and starch. The amount of the dispersion stabilizer used is, relative to 100.0 parts by mass of the polymerizable monomer, preferably 0.2 parts by mass to 20.0 parts by mass.

When, among the dispersion stabilizers, the inorganic dispersion stabilizer is used, a commercial inorganic dispersion stabilizer may be used as it is, or the inorganic compound may be produced in an aqueous medium in order to obtain the dispersion stabilizer having a finer particle diameter. For example, tricalcium phosphate can be obtained by mixing a sodium phosphate aqueous solution and a calcium chloride aqueous solution under high-speed stirring.

An external additive may be added to the toner particles in order to confer various properties to the toner. Examples of an external additive for improving the flowability of the toner include inorganic fine particles such as silica fine particles, titanium oxide fine particles and fine particles of double oxides thereof. Among the inorganic fine particles, silica fine particles and titanium oxide fine particles are preferred. The toner of the present invention can be obtained by, for example, externally adding the inorganic fine particles to the toner particles so as to allow adhesion of the fine particles on the surface of the toner particles. The inorganic fine particles may be externally added according to a well known method. For example, a method may be mentioned in which mixing is carried out with a Henschel mixer (available from Mitsui Miike Machinery Co., Ltd.).

Examples of the silica fine particles include dry silica or fumed silica prepared by vapour phase oxidation of silicon halides and wet silica prepared from water glass. The inorganic fine particles are preferably dry silica which contains a low amount of silanol groups on the surface of and inside of silica fine particles and a low amount of $Na_2O$ and $SO_3^{2-}$. The dry silica may be complex fine particles of silica and another metal oxide obtained by using a metal halide such as aluminium chloride or titanium chloride with a silicon halide during the production process.

When the inorganic fine particles are subjected to hydrophobic treatment using an agent, adjustment of the triboelectric charge quantity of the toner, improvement in environmental stability and improvement in flowability under high temperature and high humidity can be achieved. Therefore it is preferable to use the inorganic fine particles after hydrophobic treatment. When the inorganic fine particles externally added to toner absorb moisture, the toner may have a decreased triboelectric charge quantity and flowability and the image developing ability and transferability may be easily decreased.

Examples of the agent for hydrophobic treatment of the inorganic fine particles include unmodified silicone varnishes, variously modified silicone varnishes, unmodified silicone oils, variously modified silicone oils, silane compounds, silane coupling agents, other organic silicon compounds and organic titanium compounds, among which silicone oils are preferred. The agents may be used independently or two or more kinds may be used in combination.

The total amount of the inorganic fine particles added is, relative to 100.0 parts by mass of the toner particles, preferably 1.0 part by mass to 5.0 parts by mass and more preferably 1.0 part by mass to 2.5 parts by mass. The additive externally added preferably has a particle diameter that is 1/10 or less of the average particle diameter of toner particles in view of durability when the additive is added to the toner.

Methods for measurement of various physical properties according to the present invention are hereinafter described.

<Calculation of SP Value>

The SP value in the present invention was determined with the Fedors formula (3). The values of Δei and Δvi were obtained by referring to "Evaporation energy and molar volume (25° C.) of atoms and atomic groups" in Tables 3 to 9 in "*Coating no Kiso Kagaku* (Basic Science for Coating)", p. 54-57, 1986 (Maki Shoten).

$$\delta i=[Ev/V]^{(1/2)}=[\Delta ei/\Delta vi]^{(1/2)} \quad \text{Formula (3)}$$

Ev: evaporation energy

V: molar volume

Δei: evaporation energy of atoms or atomic groups of i component

Δvi: molar volume of atoms or atomic groups of i component

For example, hexanediol ($HO—CH_2—CH_2—CH_2—CH_2—CH_2—CH_2—OH$) is composed of atomic groups (—OH)×2+(—$CH_2$)×6 and thus the calculated SP is determined according to the following formula:

$$\delta i=[\Delta ei/\Delta vi]^{(1/2)}=[\{(5220)\times 2+(1180)\times 6\}/\{(13)\times 2+(16.1)\times 6\}]^{(1/2)}$$

Thus the SP value (δi) is 11.95.

<Measurement of Molecular Weight>

The weight-average molecular weight (Mw) of block polymers is measured by gel permeation chromatography (GPC) as follows:

A block polymer is first dissolved in tetrahydrofuran (THF) at room temperature. The obtained solution is then filtered through a solvent resistant membrane filter "Maishori-disc" (available from Tosoh Corporation) having a pore size of 0.2 μm to obtain a sample solution. The sample solution is adjusted to have a concentration of THF-soluble components of 0.8% by mass. The sample solution is measured under the following conditions:

Instrument: High-speed GPC instrument "HLC-8220GPC" [available from Tosoh Corporation]

Columns: LF-604, 2 in series

Eluent: THF

Flow rate: 0.6 ml/min

Oven temperature: 40° C.

Sample injection amount: 0.020 ml

In order to calculate the molecular weight of the sample, a molecular weight calibration curve is used which is prepared with standard polystyrene resins (e.g., trade name "TSK standard polystyrenes F-850, F-450, F-288, F-128, F-80, F-40, F-20, F-10, F-4, F-2, F-1, A-5000, A-2500, A-1000, A-500"; available from Tosoh Corporation).

The molecular weight of vinyl polymer segments of block polymers is measured after hydrolysis of polyester segments of the block polymers.

Specifically, to 30 mg of a block polymer are added 5 ml of dioxane and 1 ml of a 10 wt % potassium hydroxide aqueous solution and the mixture is shaken at a temperature of 70° C. for 6 hours to hydrolyse a polyester segment. The solution is thereafter dried to prepare a sample for measurement of the molecular weight of a vinyl polymer segment. The procedures thereafter are carried out in the same manner as for the block polymer.

<Measurement of Mass Ratio Between Vinyl Polymer Segment and Polyester Segment of Block Polymer>

The mass ratio between a vinyl polymer segment and a polyester segment of a block polymer ((mass of the vinyl polymer segment):(mass of the polyester segment)) was measured with a nuclear magnetic resonance spectrometry ($^1$H-NMR) [400 MHz, $CDCl_3$, room temperature (25° C.)].

Measurement instrument: FT NMR instrument JNM-EX400 (available from JEOL Ltd.)

Measurement frequency: 400 MHz

Pulse condition: 5.0 μs

Frequency range: 10500 Hz

Integration: 64 times

From the integration value of the resulting spectra, the mass ratio between the vinyl polymer segment and the polyester segment was calculated.

<Measurement of Melting Point and Half-Width>

The melting point (Tm) of a block polymer is measured with a differential scanning colorimeter "Q1000" (available from TA Instruments) according to ASTM D3418-82.

The temperature at a detector of the instrument is corrected with melting points of indium and zinc and the amount of heat is corrected with the heat of fusion of indium.

Specifically, 5 mg of a block polymer is accurately weighed, placed in an aluminium pan and measured within the measurement range of 30 to 200° C. at a ramp rate of 10° C./min using an empty aluminium pan as a reference. During the measurement, the temperature is increased to 200° C., then decreased to 30° C. at a cooling rate of 10° C./min and again increased thereafter. A maximum endothermic peak of the DSC curve in the temperature range of 30 to 200° C. during the second heating process is taken as a melting point (Tm) as measured in DSC measurement of the block polymer of the present invention. The half-width of the endothermic peak derived from the block polymer corresponded to the temperature width at half height from the base line of the endothermic peak of Tm.

<Separation of Styrene-Acrylic Resin, Block Polymer and Wax from Toner>

A styrene-acrylic resin, a block polymer and a wax are separated from the toner according to the following methods, for example. After the separation according to the following methods, identification of physical properties such as identification of the structure and calculation of the SP value can be carried out.

(Separation of Wax from Toner by Preparative Gel Permeation Chromatography (GPC))

The toner is dissolved in tetrahydrofuran (THF) and a solvent is distilled under reduced pressure from the obtained soluble matter to obtain tetrahydrofuran (THF)-soluble components in the toner.

The resulting tetrahydrofuran (THF)-soluble components in the toner were dissolved in chloroform to prepare a sample solution having a concentration of 25 mg/ml.

The resulting sample solution (3.5 ml) is injected to the following instrument and a resin component having a number average molecular weight (Mn) of 2000 or more is separated and recovered under the following conditions: Preparative GPC instrument: Preparative HPLC Type LC-980, available from Japan Analytical Industry Co., Ltd. Columns for preparative GPC: JAIGEL 3H and JAIGEL 5H (both available from Japan Analytical Industry Co., Ltd.)

Eluent: Chloroform

Flow rate: 3.5 ml/min

In order to calculate the molecular weight of the sample, a molecular weight calibration curve is used which is prepared with standard polystyrene resins (e.g., trade name "TSK standard polystyrenes F-850, F-450, F-288, F-128, F-80, F-40, F-20, F-10, F-4, F-2, F-1, A-5000, A-2500, A-1000, A-500"; available from Tosoh Corporation).

After separating and recovering the high molecular weight component derived from the resin, a solvent is distilled under reduced pressure and the residue is dried in an atmosphere of 90° C. under reduced pressure for 24 hours. These procedures are repeated until about 100 mg of resin component is obtained.

(Separation of Styrene-Acrylic Resin and Block Polymer)

Acetone (500 ml) is added to the resin (100 mg) obtained by the above procedures and heated to 70° C. in order to completely dissolve the resin. The solution is gradually cooled to 25° C. to allow re-crystallization of the block polymer. The crystalline block polymer is separated by suction filtration from a filtrate. The separated filtrate was gradually added to 500 ml of methanol to reprecipitate the styrene-acrylic resin. The styrene-acrylic resin was recovered by suction filtration. The resulting styrene-acrylic resin and block polymer were dried at 40° C. under reduced pressure for 24 hours.

<Identification of Structure of Styrene-Acrylic Resin, Block Polymer and Wax>

The structure of a styrene-acrylic resin, a block polymer and a wax was identified with nuclear magnetic resonance spectrometry ($^1$H-NMR) [400 MHz, $CDCl_3$, room temperature (25° C.)].

Measurement instrument: FT NMR instrument JNM-EX400 (available from JEOL Ltd.)
Measurement frequency: 400 MHz
Pulse condition: 5.0 μs
Frequency range: 10500 Hz
Integration: 64 times <Measurement of Amount of Block Polymer in Binder Resin from Toner>

The amount of a block polymer was calculated from the integration value of the spectra of the toner obtained by nuclear magnetic resonance spectrometry ($^1$H-NMR) based on the respective spectra of the styrene-acrylic resin and the block polymer obtained by nuclear magnetic resonance spectrometry ($^1$H-NMR).

Measurement instrument: FT NMR instrument JNM-EX400 (available from JEOL Ltd.)
Measurement frequency: 400 MHz
Pulse condition: 5.0 μs
Frequency range: 10500 Hz
Integration: 64 times

EXAMPLES

The present invention is more specifically described hereinafter by way of Examples. However, the present invention is not limited to the following Examples. Unless specifically otherwise stated, "parts" and "%" indicated in Examples and Comparative Examples are all based on the mass.

Block polymers used in Examples are first described.

<Production of Block Polymer 1>

To a reactor equipped with a stirrer, a thermometer, a nitrogen inlet tube, a draining tube and a decompressor, 100.0 parts by mass of sebacic acid, 105.0 parts by mass of 1,12-dodecanediol and 29.0 parts by mass (9.0 mol %) of 12-hydroxystearic acid were added and heated to a temperature of 130° C. while stirring. After adding an esterification catalyst which was 0.7 parts by mass of titanium(IV) isopropoxide, the temperature was raised to 160° C. and condensation polymerization was carried out over 5 hours. The temperature was then raised to 180° C. and reaction was allowed to proceed under reduced pressure until a desired molecular weight was obtained to obtain polyester (1). The polyester (1) had a weight-average molecular weight (Mw) of 18000.

Next, to a reactor equipped with a stirrer, a thermometer and a nitrogen inlet tube, 100.0 parts by mass of the polyester (1) and 440.0 parts by mass of dehydrated chloroform were added and completely dissolved. Triethylamine (5.0 parts by mass) was added thereto and 15.0 parts by mass of 2-bromoisobutyryl bromide was then gradually added while cooling on ice. The mixture was then stirred at room temperature (25° C.) for one day.

The resin solution was gradually added dropwise to a container containing 550.0 parts by mass of methanol to reprecipitate the resin component which was then filtrated, purified and dried to give polyester (2).

To a reactor equipped with a stirrer, a thermometer and a nitrogen inlet tube, 100.0 parts by mass of the polyester (2) obtained as above, 300 parts by mass of styrene, 3.5 parts by mass of copper(I) bromide and 8.5 parts by mass of pentamethyldiethylenetriamine were added and polymerization reaction was carried out while stirring at a temperature of 110° C. The reaction was terminated when a desired molecular weight was obtained, and reprecipitation with 250.0 parts by mass of methanol, filtration and purification was carried out to remove unreacted styrene and the catalyst. Thereafter drying in a vacuum drier at 50° C. gave block polymer 1 having a polyester segment and a vinyl polymer segment. Physical properties of the resulting block polymer 1 are shown in Table 3.

<Production of Block Polymers 2 to 5, 7 to 12, 14 to 16, 18 to 21, 23, 24 and 26 to 28>

Block polymers 2 to 5, 7 to 12, 14 to 16, 18 to 21, 23, 24 and 26 to 28 were obtained in the same manner as the production method of the block polymer 1 except that the starting materials and production conditions shown in Table 1 were used. Physical properties of the resulting block polymers 2 to 5, 7 to 12, 14 to 16, 18 to 21, 23, 24 and 26 to 28 are shown in Table 3.

<Production of Block Polymer 6>

In a reactor equipped with a stirrer, a thermometer, a nitrogen inlet tube and a decompressor, 100.0 parts by mass of xylene was heated while nitrogen substitution in order to reflux at a liquid temperature of 140° C. A mixture of 100.0 parts by mass of styrene and 6.0 parts by mass of dimethyl 2,2'-azobis(2-methylpropionate) was added dropwise to the solution over 3 hours and the solution was stirred for 3 hours after the dropwise addition. Xylene and the residual styrene were then distilled off at 160° C. and 1 hPa to give vinyl polymer (1).

In a reactor equipped with a stirrer, a thermometer, a nitrogen inlet tube, a draining tube and a decompressor, 100.0 parts by mass of the vinyl polymer (1) obtained as above, 80.0 parts of xylene as an organic solvent and 32.3 parts by mass of 1,12-dodecanediol were added with 0.5 parts of titanium(IV) isopropoxide as an esterification catalyst and allowed to react in a nitrogen atmosphere at 150° C. for 4 hours. Thereafter 33.3 parts by mass of sebacic acid and 3.85 parts by mass of neopentyl glycol were added and allowed to react at 150° C. for 3 hours and at 180° C. for 4 hours. The reaction was allowed to proceed thereafter at 180° C. and 1 hPa until a desired Mw was obtained to give block polymer 6.

<Production of Block Polymers 13, 17, 22 and 25>

Block polymers 13, 17, 22 and 25 were obtained in the same manner as the production method of the block polymer 6 except that the starting materials and production conditions shown in Table 2 were used. Physical properties of the resulting block polymers 13, 17, 22 and 25 are shown in Table 3.

<Production of Crystalline Polyester 29>

To a reactor equipped with a stirrer, a thermometer, a nitrogen inlet tube, a draining tube and a decompressor, 100.0 parts by mass of sebacic acid and 105.0 parts by mass of 1,12-dodecanediol were added and heated while stirring to a temperature of 130° C. After addition of 0.7 parts by mass of titanium(IV) isopropoxide, the temperature was raised to 160° C. and condensation polymerization was carried out over 5 hours to give crystalline polyester 29. Physical properties of the crystalline polyester 29 are shown in Table 3.

TABLE 1

| Block poly-mer No. | Polyester segment: Linear alkanedicarboxylic acid: Monomer | Parts by mass | Linear alkanediol: Monomer | Parts by mass | Alkane compound: Species | Parts by mass (mol %) | Reaction condition | Vinyl polymer segment: Monomer | Parts by mass | Reaction condition |
|---|---|---|---|---|---|---|---|---|---|---|
| 1 | Sebacic acid | 100.0 | 1,12-Dodecanediol | 105.0 | 12HS | 29.0 (9.0) | 160° C./5H | St = 100 | 300.0 | 110° C. |
| 2 | Tetradecanedioic acid | 100.0 | 1,12-Dodecanediol | 85.0 | 12HS | 26.0 (10.0) | 160° C./5H | St = 100 | 400.0 | 100° C. |
| 3 | Adipic acid | 100.0 | 1,12-Dodecanediol | 145.0 | 12HS | 18.0 (4.0) | 160° C./5H | St = 100 | 300.0 | 110° C. |
| 4 | Sebacic acid | 100.0 | 1,6-Hexanediol | 65.0 | 12HS | 37.0 (10.0) | 160° C./5H | St = 100 | 200.0 | 110° C. |
| 5 | Hexadecanedioic acid | 100.0 | 1,12-Dodecanediol | 75.0 | 12HS | 9.0 (4.0) | 150° C./6H | St = 100 | 300.0 | 110° C. |
| 7 | Dodecanedioic acid | 100.0 | 1,12-Dodecanediol | 95.0 | ODS | 41.0 (11.0) | 170° C./5H | St = 100 | 400.0 | 110° C. |
| 8 | Sebacic acid | 100.0 | 1,12-Dodecanediol | 130.0 | DMM | 16.5 (10.0) | 160° C./5H | St = 100 | 300.0 | 110° C. |
| 9 | Sebacic acid | 100.0 | 1,12-Dodecanediol | 105.0 | 3H15MHD | 31.5 (10.0) | 150° C./6H | St = 100 | 300.0 | 100° C. |
| 10 | Sebacic acid | 100.0 | 1,12-Dodecanediol | 85.0 | 1,2-DO | 34.0 (10.0) | 160° C./6H | St = 100 | 300.0 | 110° C. |
| 11 | Sebacic acid | 100.0 | 1,12-Dodecanediol | 105.0 | 12HS | 74.0 (20.0) | 160° C./6H | St = 100 | 300.0 | 110° C. |
| 12 | Sebacic acid | 100.0 | 1,12-Dodecanediol | 105.0 | 12HS | 3.0 (1.0) | 150° C./6H | St:MMA = 92:8 | 250.0 | 110° C. |
| 14 | Sebacic acid | 100.0 | 1,12-Dodecanediol | 105.0 | 12HS | 29.0 (9.0) | 160° C./5H | Stn-BA = 95:5 | 450.0 | 90° C. |
| 15 | Sebacic acid | 100.0 | 1,12-Dodecanediol | 105.0 | 12HS | 29.0 (9.0) | 170° C./4H | St = 100 | 600.0 | 110° C. |
| 16 | Sebacic acid | 100.0 | 1,12-Dodecanediol | 105.0 | 12HS | 29.0 (9.0) | 170° C./4H | St = 100 | 600.0 | 110° C. |
| 18 | Sebacic acid | 100.0 | 1,5-Pentanediol | 55.0 | 12HS | 29.0 (9.0) | 160° C./5H | St = 100 | 250.0 | 110° C. |
| 19 | Octadecanedioic acid | 100.0 | 1,16-Hexadecane-diol | 85.0 | ODS | 54.5 (20.0) | 170° C./6H | St = 100 | 400.0 | 100° C. |
| 20 | Sebacic acid | 100.0 | 1,4-Butanediol | 50.0 | 12HS | 12.5 (4.0) | 160° C./5H | St = 100 | 250.0 | 110° C. |
| 21 | Sebacic acid | 100.0 | 1,12-Dodecanediol | 105.0 | 12HS | 29.0 (9.0) | 160° C./5H | St = 100 | 250.0 | 110° C. |
| 23 | Sebacic acid | 100.0 | 1,12-Dodecanediol | 105.0 | 12HS | 29.0 (9.0) | 160° C./5H | St = 100 | 300.0 | 110° C. |
| 24 | Sebacic acid | 100.0 | 1,12-Dodecanediol | 105.0 | 12HS | 29.0 (9.0) | 160° C./5H | St = 100 | 300.0 | 110° C. |
| 26 | Tetradecanedioic acid | 100.0 | 1,12-Dodecanediol | 85.0 | — | — | 160° C./5H | St = 100 | 300.0 | 110° C. |
| 27 | Hexadecanedioic acid | 100.0 | 1,14-Tetradecane-diol | 85.0 | 12HS | 13.5 (6.0) | 160° C./5H | St = 100 | 300.0 | 110° C. |
| 28 | Sebacic acid | 100.0 | 1,3-Propanediol | 45.0 | 12HS | 12.5 (4.0) | 160° C./5H | St = 100 | 300.0 | 110° C. |

In Table 1, 12HS denotes 12-hydroxystearic acid, ODS denotes octadecylsuccinic anhydride, DMM denotes dimethylmalonic acid, 3H15MHD denotes 3-hydroxy-15 methylhexadecanoic acid, 1,2-DO denotes 1,2-docosanediol, St denotes styrene, MMA denotes methyl methacrylate and n-BA denotes n-butyl acrylate.

TABLE 2

| Block poly-mer No. | Polyester segment: Linear alkanedicarboxylic acid: Monomer | Parts by mass | Linear alkanediol: Monomer | Parts by mass | Alkane compound: Mono-mer | Parts by mass (mol %) | Amount of catalyst [parts] | Vinyl polymer segment: Mono-mer | Parts by mass | Parts of initiator | Reaction temperature |
|---|---|---|---|---|---|---|---|---|---|---|---|
| 6 | Sebacic acid | 100.0 | 1,12-Dodecanediol | 97.0 | NP | 11.5 (10.0) | 0.5 | St | 300.0 | 6.0 | 150° C. |
| 13 | Sebacic acid | 100.0 | 1,12-Dodecanediol | 105.0 | 12HS | 95.0 (24.0) | 0.6 | St | 400.0 | 6.0 | 140° C. |
| 17 | Sebacic acid | 100.0 | 1,12-Dodecanediol | 105.0 | 12HS | 12.5 (4.0) | 0.4 | St | 250.0 | 10.0 | 150° C. |
| 22 | Sebacic acid | 100.0 | 1,12-Dodecanediol | 105.0 | 12HS | 29.0 (9.0) | 0.5 | St | 400.0 | 5.0 | 130° C. |
| 25 | Sebacic acid | 100.0 | 1,12-Dodecanediol | 105.0 | 12HS | 29.0 (9.0) | 0.5 | St | 400.0 | 5.0 | 140° C. |

In Table 2, 12HS denotes 12-hydroxystearic acid and NP denotes neopentyl glycol.

TABLE 3

| Block polymer No. | Polyester segment Mw | Polyester segment SPC | Vinyl polymer segment Mw | Entire block polymer: Vinyl polymer segment/polyester segment | Entire block polymer: Tm | Entire block polymer: Half-width | Entire block polymer: Mw |
|---|---|---|---|---|---|---|---|
| 1 | 18000 | 9.43 | 8000 | 40/60 | 69 | 6.7 | 34000 |
| 2 | 15000 | 9.31 | 10000 | 55/45 | 83 | 6.8 | 35000 |
| 3 | 18000 | 9.63 | 8000 | 45/55 | 62 | 5.4 | 30000 |
| 4 | 18000 | 9.66 | 7000 | 35/65 | 51 | 7.3 | 26000 |
| 5 | 16000 | 9.28 | 6000 | 50/50 | 94 | 5.1 | 24000 |
| 6 | — | 9.51 | 10000 | 55/45 | 68 | 7.4 | 37000 |
| 7 | 19000 | 9.39 | 9000 | 55/45 | 72 | 7.8 | 39000 |
| 8 | 17000 | 9.48 | 8000 | 50/50 | 69 | 7.2 | 30000 |
| 9 | 18000 | 9.41 | 8000 | 50/50 | 67 | 7.6 | 32000 |
| 10 | 19000 | 9.40 | 9000 | 50/50 | 66 | 8.0 | 32000 |
| 11 | 18000 | 9.36 | 8000 | 40/60 | 62 | 11.6 | 34000 |
| 12 | 20000 | 9.48 | 8000 | 35/65 | 76 | 2.9 | 34000 |
| 13 | — | 9.36 | 11000 | 60/40 | 55 | 12.3 | 34000 |
| 14 | 8000 | 9.43 | 14000 | 70/30 | 67 | 7.3 | 38000 |
| 15 | 6000 | 9.43 | 10000 | 80/20 | 63 | 8.5 | 27000 |
| 16 | 6000 | 9.43 | 14000 | 85/15 | 62 | 9.5 | 34000 |
| 17 | — | 9.43 | 4500 | 30/70 | 72 | 5.2 | 31000 |
| 18 | 24000 | 9.79 | 8000 | 35/65 | 56 | 6.5 | 34000 |
| 19 | 8000 | 9.13 | 13000 | 65/35 | 68 | 11.4 | 37000 |
| 20 | 19000 | 9.88 | 7000 | 35/65 | 56 | 4.8 | 34000 |
| 21 | 20000 | 9.43 | 4000 | 35/65 | 71 | 6.3 | 25000 |
| 22 | — | 9.43 | 15000 | 60/40 | 66 | 7.1 | 38000 |
| 23 | 8000 | 9.43 | 5000 | 65/35 | 67 | 7.5 | 14000 |
| 24 | 8000 | 9.43 | 6000 | 65/35 | 67 | 7.0 | 16000 |
| 25 | 10000 | 9.43 | 7000 | 40/60 | 69 | 7.0 | 21000 |
| 26 | 17000 | 9.35 | 7500 | 45/55 | 92 | 2.5 | 34500 |
| 27 | 18000 | 9.24 | 8000 | 40/60 | 98 | 5.7 | 35000 |
| 28 | 16000 | 9.96 | 7000 | 40/60 | 48 | 5.3 | 33000 |
| 29 (Crystalline polyester) | 22000 | 9.48 | — | — | 82 | 2.2 | 22000 |

In Table 3, Half-width denotes the half-width of an endothermic peak derived from a block polymer.

<Production of Negative Chargeability Control Resin 1>

To a pressurizable reactor equipped with a condenser, a stirrer, a thermometer, a nitrogen inlet tube, a dripping apparatus and a decompressor, 255.0 parts by mass of methanol, 145.0 parts by mass of 2-butanone and 100.0 parts by mass of 2-propanol were added as solvents, and 88.0 parts by mass of styrene, 6.0 parts by mass of 2-ethylhexyl acrylate and 5.0 parts by mass of 2-acrylamido-2-methylpropanesulphonic acid as polymerizable monomers were added thereto and heated to a reflux temperature while stirring. A solution of a polymerization initiator, 1.0 parts by mass of 2,2'-azobisisobutyronitrile, diluted in 20.0 parts by mass of 2-butanone was added dropwise over 30 minutes and stirring was continued for 5 hours. A solution of 1.2 parts by mass of 2,2'-azobisisobutyronitrile diluted in 20.0 parts by mass of 2-butanone was further added dropwise over 30 minutes, stirring was continued for 5 hours and polymerization was terminated to obtain aggregates.

The aggregates obtained after distillation of the polymerization solvents under reduced pressure were then coarsely pulverized on a cutter mill with a 150-mesh screen (mesh size: 104 μm) attached thereto so as to be 100 μm or less and further finely pulverized on a jet mill. The fine powder was sieved on a 250-mesh sieve (mesh size: 61 μm), so that particles of 60 μm or less were separated and recovered. The particles were then dissolved in methyl ethyl ketone (MEK) so as to obtain a concentration of 10% and the solution was gradually poured into methanol of an amount of 20 times of MEK in order to effect reprecipitation. The resulting precipitate was washed with methanol of an amount of a half of the amount used for reprecipitation and the filtered particles were vacuum dried at a temperature of 35° C. for 48 hours.

The particles after vacuum drying were re-dissolved in MEK so as to obtain a concentration of 10% and the solution was gradually poured into n-hexane of an amount of 20 times of MEK in order to effect reprecipitation. The resulting precipitate was washed with n-hexane of an amount of a half of the amount used for reprecipitation and the filtered particles were vacuum dried at 35° C. for 48 hours to give a polar polymer. The thus obtained polar polymer had a glass transition temperature (Tg) of 83° C., a main peak molecular weight (Mp) of 21,500, a number average molecular weight (Mn) of 11,000, a weight-average molecular weight (Mw) of 33,000 and an acid value of 14.5 mg-KOH/g. The polar polymer had the composition as measured by $^{1}$H-NMR (EX-400 available from JEOL Ltd.: 400 MHz) of styrene:2-ethylhexyl acrylate:2-acrylamido-2-methylpropanesulphonic acid=88.0:6.0:5.0 (mass ratio). The resulting polar polymer is designated as negative chargeability control resin 1.

<Production of Toner 1>

To 1300.0 parts by mass of ion-exchange water heated to a temperature of 60° C., 9.0 parts by mass of tricalcium phosphate was added and stirred at a stirring speed of 15,000 rpm with a T.K. Homomixer (available from Tokushu Kika Kogyo Co., Ltd.) to prepare an aqueous medium.

The following materials for binder resin preparation were mixed while stirring at a stirring speed of 100 rpm with a propeller stirrer to prepare a mixture:

| | |
|---|---|
| Styrene | 50.0 parts by mass |
| n-Butylacrylate | 15.0 parts by mass |
| Block polymer 1 | 35.0 parts by mass |

To the solution, the following materials were added:

| | |
|---|---|
| Cyan colorant (C.I. pigment blue 15:3) | 6.5 parts by mass |
| Negative charge control agent (Bontron E-88, available from Orient Chemical Industries Co., Ltd.) | 0.5 parts by mass |
| WAX 1 (hydrocarbon wax, Tm = 78° C.) | 9.0 parts by mass |
| Negative chargeability control resin 1 | 0.7 parts by mass |
| Polar resin (a styrene-2-hydroxyethyl methacrylate-methacrylic acid-methyl methacrylate copolymer, acid value: 10 mg-KOH/g, Tg = 80° C., Mw = 15,000). | 5.0 parts by mass |

The mixture was then heated to a temperature of 65° C., stirred at a stirring speed of 10,000 rpm with a T.K. Homomixer (available from Tokushu Kika Kogyo Co., Ltd.) for dissolution and dispersion to prepare a polymerizable monomer composition.

Subsequently the polymerizable monomer composition was added to the aqueous medium and a polymerization initiator:

Perbutyl PV (10-hour half-life decomposition temperature: 54.6° C. (available from NOF Corporation)) 6.0 parts by mass was added. The mixture was stirred at a stirring speed of 15,000 rpm at a temperature of 70° C. with a T.K. Homomixer for 20 minutes for granulation.

After transferring to a propeller stirrer, the polymerizable monomers in the polymerizable monomer composition, i.e., styrene and n-butyl acrylate were polymerized at 85° C. for 5 hours while stirring at a stirring speed of 200 rpm to produce slurry containing toner particles. After the polymerization reaction, the slurry was cooled. Hydrochloric acid was added to the cooled slurry to adjust pH to 1.4 and the mixture was stirred for 1 hour to dissolve calcium phosphate. The slurry was washed with water of an amount of 10 times of the slurry, filtered and dried followed by classification for adjustment of the particle diameter to obtain toner particles. The toner particles contained the styrene-acrylic resin at 65.0 parts by mass, the block polymer at 35.0 parts by mass, the cyan colorant at 6.5 parts by mass, the wax at 9.0 parts by mass, the negative charge control agent at 0.5 parts by mass, the negative chargeability control resin 1 at 0.7 parts by mass and the polar resin at 5.0 parts by mass.

Relative to 100.0 parts by mass of the toner particles, an external additive, which was 1.5 parts by mass of hydrophobic silica fine particles (primary particle diameter: 7 nm, BET specific surface area: 130 $m^2/g$) obtained by treating silica fine particles with 20% by mass of dimethyl silicone oil relative to the silica fine particles, was added and mixed at a stirring speed of 3000 rpm with a Henschel mixer (available from Mitsui Miike Machinery Co., Ltd.) for 15 minutes to obtain a toner 1. Physical properties of the toner 1 are shown in Table 4.

<Production of Toners 2 to 34 and 38 to 44>

Toners 2 to 34 and 38 to 44 were obtained in the same production method as the toner 1 except that the starting materials and the amount of addition shown in Table 4 were used.

<Production of Toner 35>

| | |
|---|---|
| Styrene-acrylic resin (a copolymer of styrene:n-butyl acrylate = 80:20 (mass ratio)) (Mw = 30,000, Tg = 55° C.) | 65.0 parts by mass |
| Block polymer 1 | 35.0 parts by mass |
| Methyl ethyl ketone | 100.0 parts by mass |
| Ethyl acetate | 100.0 parts by mass |
| WAX 1 (hydrocarbon wax, Tm = 78° C.) | 9.0 parts by mass |
| Cyan colorant (C.I. pigment blue 15:3) | 6.5 parts by mass |
| Negative chargeability control resin 1 | 1.0 parts by mass |

The above materials were dispersed on an attritor (available from Mitsui Mining & Smelting Co., Ltd.) for 3 hours to obtain a colorant-dispersed solution.

Meanwhile 27.0 parts by mass of calcium phosphate was added to 3000.0 parts by mass of ion-exchange water heated to a temperature of 60° C. and stirred at a stirring speed of 10,000 rpm with a T.K. Homomixer (available from Tokushu Kika Kogyo Co., Ltd.) to prepare an aqueous medium. The colorant-dispersed solution was poured to the aqueous medium, stirred for 15 minutes at a stirring speed of 12,000 rpm with the T.K. Homomixer at a temperature of 65° C. in an $N_2$ atmosphere to granulate colorant particles. Thereafter the T.K. Homomixer was replaced with a conventional propeller stirrer and the solvents were removed from the dispersed solution while maintaining the stirring speed of the stirrer at 150 rpm, increasing the internal temperature to a temperature of 95° C. and maintaining the temperature for 3 hours to prepare a dispersed solution of toner particles.

Hydrochloric acid was added to the resulting dispersed solution of toner particles to adjust pH to 1.4 and the mixture was stirred for 1 hour to dissolve calcium phosphate. The dispersed solution was filtered on a press filter and washed to give toner aggregates. The toner aggregates were pulverized and dried to give toner particles. The toner particles contained the styrene-acrylic resin at 65.0 parts by mass, the block polymer at 35.0 parts by mass, the cyan colorant at 6.5 parts by mass, the wax at 9.0 parts by mass and the negative chargeability control resin 1 at 1.0 part by mass. Relative to 100.0 parts by mass of the resulting toner particles, an external additive, which was 1.5 parts by mass of hydrophobic silica fine particles (primary particle diameter: 7 nm, BET specific surface area: 130 $m^2/g$) obtained by treating silica fine particles with 20% by mass of dimethyl silicone oil relative to the silica fine particles, was added and mixed at a stirring speed of 3000 rpm with a Henschel mixer (available from Mitsui Miike Machinery Co., Ltd.) for 15 minutes to obtain a toner 35. Physical properties of the toner 35 are shown in Table 4.

<Production of Toner 36>

(Preparation of Resin Particle Dispersed Solution 1)

| | |
|---|---|
| Styrene | 75.0 parts by mass |
| n-Butylacrylate | 25.0 parts by mass |

The above materials were mixed and dissolved. The solution was dispersed and emulsified in 1.5 parts by mass of a nonionic surfactant (available from Sanyo Chemical Industries, Ltd.: Nonipol 400) and 2.2 parts by mass of an anionic surfactant (available from Dai-ichi Kogyo Seiyaku Co., Ltd.: Neogen SC) dissolved in 120.0 parts by mass of ion-exchange water. While slowly mixing for 10 minutes, to the emulsion, 1.5 parts by mass of ammonium persulphate as a polymerization initiator dissolved in 10.0 parts by mass of ion-exchange water was poured, and after nitrogen substitution, heated while stirring up to a temperature of 70° C. of the content to allow continuation of emulsion polymerization for 4 hours, thereby preparing a resin particle dispersed solution 1 containing resin particles having an average particle diameter of 0.29 μm dispersed therein.

(Preparation of Resin Particle Dispersed Solution 2)

Block polymer 5 100.0 parts by mass

The above material which was dissolved was dispersed and emulsified in 1.5 parts by mass of a nonionic surfactant (available from Sanyo Chemical Industries, Ltd.: Nonipol 400) and 2.2 parts by mass of an anionic surfactant (available from Dai-ichi Kogyo Seiyaku Co., Ltd.: Neogen SC) dissolved in 120.0 parts by mass of ion-exchange water. A resin particle dispersed solution 2 was prepared which contained resin particles having an average particle diameter of 0.31 μm dispersed therein.

(Preparation of Colorant Particle Dispersed Solution)

| | |
|---|---|
| Cyan colorant (C.I. pigment blue 15:3) | 20.0 parts by mass |
| Anionic surfactant (available from Dai-ichi Kogyo Seiyaku Co., Ltd.: Neogen SC) | 3.0 parts by mass |
| Ion-exchange water | 78.0 parts by mass |

The above materials were mixed and dispersed on a sand grinding mill. The particle size distribution of the colorant particle dispersed solution was measured on a particle size distribution analyzer (available from Horiba, Ltd., LA-700), and it was found that the colorant particles contained had an average particle diameter of 0.2 μm and no coarse particles of more than 1 μm were not observed.

(Preparation of Wax Particle Dispersed Solution)

| | |
|---|---|
| WAX 1 (hydrocarbon wax, Tm = 78° C.) | 50.0 parts by mass |
| Anionic surfactant (available from Dai-ichi Kogyo Seiyaku Co., Ltd.: Neogen SC) | 7.0 parts by mass |
| Ion-exchange water | 200.0 parts by mass |

The above materials were heated to a temperature of 95° C., dispersed on a homogenizer (available from IKA: Ultra-Turrax T50) followed by dispersing on a pressure-ejection homogenizer to prepare a wax particle dispersed solution containing wax having an average particle diameter of 0.5 μm dispersed therein.

(Preparation of Charge Control Particle Dispersed Solution)

| | |
|---|---|
| Metal compound of di-alkyl-salicylic acid (negative charge control agent, Bontron E-84, available from Orient Chemical Industries Co., Ltd.) | 5.0 parts by mass |
| Anionic surfactant (available from Dai-ichi Kogyo Seiyaku Co., Ltd.: Neogen SC) | 3.0 parts by mass |
| Ion-exchange water | 78.0 parts by mass |

The above materials were mixed and dispersed on a sand grinding mill.

(Preparation of Mixed Solution)

| | |
|---|---|
| Resin particle dispersed solution 1 | 150.0 parts by mass |
| Resin particle dispersed solution 2 | 77.5 parts by mass |
| Colorant particle dispersed solution | 27.5 parts by mass |
| wax particle dispersed solution | 45.0 parts by mass |

The above solutions were placed and stirred in a 1-L reaction flask equipped with a stirrer, a condenser and a thermometer. The mixture was adjusted to have pH of 5.2 with 1 mol/L potassium hydroxide.

To the mixture, a flocculant which was 120.0 parts by mass of 8% sodium chloride aqueous solution was added dropwise and the mixture was heated to a temperature of 55° C. while stirring. At this temperature, 10.0 parts by mass of the charge control particle dispersed solution was added. After maintaining the temperature at 55° C. for 2 hours, the mixture was observed under an optical microscope, which revealed formation of aggregated particles having an average particle diameter of 3.3 μm.

Thereafter, 3.0 parts by mass of an anionic surfactant (available from Dai-ichi Kogyo Seiyaku Co., Ltd.: Neogen SC) was added to the mixture which was then heated to a temperature of 95° C. while maintaining stirring and the temperature was maintained for 4.5 hours. After cooling, the reaction product was filtered, thoroughly washed with ion-exchange water and then subjected to fluidized bed drying at a temperature of 45° C. to give toner particles. The toner particles contained 65.0 parts by mass of the styrene-acrylic resin, 35.0 parts by mass of the block polymer, 5.5 parts by mass of the cyan colorant, 9.0 parts by mass of the wax and 0.6 parts by mass of the negative chargeability control resin.

Relative to 100.0 parts by mass of the resulting toner particles, an external additive, which was 1.5 parts by mass of hydrophobic silica fine particles (primary particle diameter: 7 nm, BET specific surface area: 130 $m^2/g$) obtained by treating silica fine particles with 20% by mass of dimethyl silicone oil relative to the silica fine particles, was added and mixed at a stirring speed of 3000 rpm with a Henschel mixer (available from Mitsui Miike Machinery Co., Ltd.) for 15 minutes to obtain a toner 36. Physical properties of the toner 36 are shown in Table 4.

<Production of Toner 37>

The following materials were mixed and melt-kneaded on a twin-screw extruder. The cooled kneaded product was coarsely pulverized with a hammer mill and the obtained finely pulverized material was classified to give toner particles.

| | |
|---|---|
| Binder resin A styrene-n-butyl acrylate copolymer resin (Mw = 30,000, Tg = 50° C.) | 65.0 parts by mass |
| Block polymer 5 | 35.0 parts by mass |
| C.I. Pigment Blue 15:3 | 5.5 parts by mass |
| Metal compound of di-alkyl-salicylic acid (available from Orient Chemical Industries Co., Ltd.: Bontron E88] | 3.0 parts by mass |
| WAX 1 (hydrocarbon wax, Tm = 78° C.) | 6.0 parts by mass |

Relative to 100.0 parts by mass of the resulting toner particles, an external additive, which was 1.5 parts by mass of hydrophobic silica fine particles (primary particle diameter: 7 nm, BET specific surface area: 130 $m^2/g$) obtained by treating silica fine particles with 20% by mass of dimethyl silicone oil relative to the silica fine particles, was added and mixed at a stirring speed of 3000 rpm with a Henschel mixer (available from Mitsui Miike Machinery Co., Ltd.) for 15 minutes to obtain a toner 37. Physical properties of the toner 37 are shown in Table 4.

Physical properties of the respective toners are shown in Table 4.

In Table 4, WAX 1 denotes a hydrocarbon wax (Tm=78° C.), WAX 2 denotes a dipentaerythritol ester wax (Tm=77° C.) and WAX 3 denotes a dipentaerythritol ester wax (Tm=64° C.).

TABLE 4

| | | Binder resin | | | | | WAX | |
|---|---|---|---|---|---|---|---|---|
| | | Block polymer | Amount [parts by mass] | Styrene-acrylic resin | SPB | Parts by mass | WAX | SPW |
| Example 1 | Toner 1 | 1 | 35.0 | Styrene/n-butyl acrylate = 75/25 | 9.80 | 65.0 | WAX 1 | 8.15 |
| Example 2 | Toner 2 | 2 | 35.0 | Styrene/n-butyl acrylate = 75/25 | 9.80 | 65.0 | WAX 1 | 8.15 |
| Example 3 | Toner 3 | 3 | 35.0 | Styrene/n-butyl acrylate = 75/25 | 9.80 | 65.0 | WAX 1 | 8.15 |
| Example 4 | Toner 4 | 4 | 35.0 | Styrene/n-butyl acrylate = 75/25 | 9.80 | 65.0 | WAX 1 | 8.15 |
| Example 5 | Toner 5 | 5 | 35.0 | Styrene/n-butyl acrylate = 75/25 | 9.80 | 65.0 | WAX 1 | 8.15 |
| Example 6 | Toner 6 | 1 | 35.0 | Styrene/iso-butyl acrylate = 69/31 | 9.73 | 65.0 | WAX 1 | 8.15 |
| Example 7 | Toner 7 | 1 | 35.0 | Styrene/n-propyl acrylate = 74/26 | 9.85 | 65.0 | WAX 1 | 8.15 |
| Example 8 | Toner 8 | 1 | 35.0 | Styrene/2-ethylhexyl acrylate = 85/15 | 9.68 | 65.0 | WAX 1 | 8.15 |
| Example 9 | Toner 9 | 6 | 35.0 | Styrene/n-butyl acrylate = 75/25 | 9.80 | 65.0 | WAX 1 | 8.15 |
| Example 10 | Toner 10 | 7 | 35.0 | Styrene/n-butyl acrylate = 75/25 | 9.80 | 65.0 | WAX 1 | 8.15 |
| Example 11 | Toner 11 | 8 | 35.0 | Styrene/n-butyl acrylate = 75/25 | 9.80 | 65.0 | WAX 1 | 8.15 |
| Example 12 | Toner 12 | 9 | 35.0 | Styrene/n-butyl acrylate = 75/25 | 9.80 | 65.0 | WAX 1 | 8.15 |
| Example 13 | Toner 13 | 10 | 35.0 | Styrene/n-butyl acrylate = 75/25 | 9.80 | 65.0 | WAX 1 | 8.15 |
| Example 14 | Toner 14 | 11 | 35.0 | Styrene/n-butyl acrylate = 75/25 | 9.80 | 65.0 | WAX 1 | 8.15 |
| Example 15 | Toner 15 | 12 | 35.0 | Styrene/n-butyl acrylate = 75/25 | 9.80 | 65.0 | WAX 1 | 8.15 |
| Example 16 | Toner 16 | 13 | 35.0 | Styrene/n-butyl acrylate = 75/25 | 9.80 | 65.0 | WAX 1 | 8.15 |
| Example 17 | Toner 17 | 14 | 35.0 | Styrene/n-butyl acrylate = 75/25 | 9.80 | 65.0 | WAX 1 | 8.15 |
| Example 18 | Toner 18 | 15 | 35.0 | Styrene/n-butyl acrylate = 75/25 | 9.80 | 65.0 | WAX 1 | 8.15 |
| Example 19 | Toner 19 | 16 | 35.0 | Styrene/n-butyl acrylate = 75/25 | 9.80 | 65.0 | WAX 1 | 8.15 |
| Example 20 | Toner 20 | 17 | 35.0 | Styrene/n-butyl acrylate = 75/25 | 9.80 | 65.0 | WAX 1 | 8.15 |
| Example 21 | Toner 21 | 1 | 10.0 | Styrene/n-butyl acrylate = 75/25 | 9.80 | 90.0 | WAX 1 | 8.15 |
| Example 22 | Toner 22 | 1 | 20.0 | Styrene/n-butyl acrylate = 75/25 | 9.80 | 80.0 | WAX 1 | 8.15 |
| Example 23 | Toner 23 | 1 | 50.0 | Styrene/n-butyl acrylate = 75/25 | 9.80 | 50.0 | WAX 1 | 8.15 |
| Example 24 | Toner 24 | 1 | 6.0 | Styrene/n-butyl acrylate = 75/25 | 9.80 | 94.0 | WAX 1 | 8.15 |
| Example 25 | Toner 25 | 1 | 2.0 | Styrene/n-butyl acrylate = 75/25 | 9.80 | 65.0 | WAX 1 | 8.15 |
| Example 26 | Toner 26 | 1 | 1.0 | Styrene/n-butyl acrylate = 75/25 | 9.80 | 65.0 | WAX 1 | 8.15 |
| Example 27 | Toner 27 | 18 | 35.0 | Styrene/n-butyl acrylate = 75/25 | 9.80 | 65.0 | WAX 1 | 8.15 |
| Example 28 | Toner 28 | 1 | 35.0 | Styrene/tert-butyl acrylate = 28/72 | 9.48 | 65.0 | WAX 1 | 8.15 |
| Example 29 | Toner 29 | 19 | 35.0 | Styrene/n-propyl acrylate = 74/26 | 9.85 | 65.0 | WAX 1 | 8.15 |
| Example 30 | Toner 30 | 1 | 35.0 | Styrene/n-butyl acrylate = 75/25 | 9.80 | 65.0 | WAX 2 | 9.02 |
| Example 31 | Toner 31 | 20 | 35.0 | Styrene/n-butyl acrylate = 75/25 | 9.80 | 65.0 | WAX 1 | 8.15 |
| Example 32 | Toner 32 | 1 | 35.0 | Styrene/n-butyl acrylate = 75/25 | 9.80 | 65.0 | WAX 3 | 9.08 |
| Example 33 | Toner 33 | 21 | 35.0 | Styrene/n-butyl acrylate = 75/25 | 9.80 | 65.0 | WAX 1 | 8.15 |
| Example 34 | Toner 34 | 22 | 35.0 | Styrene/n-butyl acrylate = 75/25 | 9.80 | 65.0 | WAX 1 | 8.15 |
| Example 35 | Toner 35 | 1 | 35.0 | Styrene/n-butyl acrylate = 80/20 | 9.80 | 65.0 | WAX 1 | 8.15 |
| Example 36 | Toner 36 | 1 | 35.0 | Styrene/n-butyl acrylate = 75/25 | 9.80 | 65.0 | WAX 1 | 8.15 |
| Example 37 | Toner 37 | 1 | 35.0 | Styrene/n-butyl acrylate = 75/25 | 9.80 | 65.0 | WAX 1 | 8.15 |
| Example 38 | Toner 38 | 23 | 35.0 | Styrene/n-butyl acrylate = 75/25 | 9.80 | 65.0 | WAX 1 | 8.15 |
| Example 39 | Toner 39 | 24 | 35.0 | Styrene/n-butyl acrylate = 75/25 | 9.80 | 65.0 | WAX 1 | 8.15 |
| Example 40 | Toner 40 | 25 | 35.0 | Styrene/n-butyl acrylate = 75/25 | 9.80 | 65.0 | WAX 1 | 8.15 |
| Comparative Example 1 | Toner 41 | 29 | 35.0 | Styrene/n-butyl acrylate = 75/25 | 9.80 | 65.0 | WAX 1 | 8.15 |
| Comparative Example 2 | Toner 42 | 26 | 35.0 | Styrene/n-butyl acrylate = 75/25 | 9.80 | 65.0 | WAX 1 | 8.15 |
| Comparative Example 3 | Toner 43 | 27 | 35.0 | Styrene/n-butyl acrylate = 75/25 | 9.80 | 65.0 | WAX 1 | 8.15 |
| Comparative Example 4 | Toner 44 | 28 | 35.0 | Styrene/n-butyl acrylate = 75/25 | 9.80 | 65.0 | WAX 1 | 8.15 |

<Image Evaluation>

For image evaluation, a commercial colour laser printer [HP Color LaserJet 3525dn] was partially modified and used. Specifically, the printer was modified so as to operate even with only one colour processing cartridge. The fixing unit was also modified so as to allow adjustment to a desired temperature.

The toner was removed from the black toner processing cartridge originally mounted on the colour laser printer and the cartridge was cleaned by blowing air. Each toner (300 g) was introduced into the processing cartridge and the processing cartridge replaced with the toner was mounted on the colour laser printer and used for the image evaluation as follows. Specific image evaluation items are described hereinbelow.

[Durability]

Under an atmosphere of normal temperature and normal humidity (temperature: 23° C./humidity: 60% RH) and under an atmosphere of high temperature and high humidity (temperature: 33° C./humidity: 85% RH), printing test of 50000 sheets of horizontal lines at a printing rate of 0.5% was carried out. Thereafter a halftone (amount of toner: 0.6 mg/cm$^2$) image was printed on a letter-size XEROX 4200 paper (available from XEROX, 75 g/m$^2$) to evaluate occurrence of development stripes.

(Evaluation Criteria)

A: No occurrence

B: Development stripes occurred at 1 to 2 positions

C: Development stripes occurred at 3 to 4 positions

D: Development stripes occurred at 5 to 6 positions

E: Development stripes occurred at 7 or more positions, or occurred over 0.5 mm or longer

[Low-Temperature Fixability]

A solid image (amount of toner: 0.9 mg/cm$^2$) was printed on a transfer material at each of various fixation temperatures (80 to 140° C.) and evaluated according to the following criteria. The fixation temperature was measured on the surface of a fixation roller with a non-contact thermometer. The transfer material used was a letter-size plain paper (XEROX 4200, available from XEROX, 75 g/m$^2$).

(Evaluation Criteria)

A: No offsetting at 100° C. (particularly excellent low-temperature fixability)

B: Offsetting at 100° C. (excellent low-temperature fixability)

C: Offsetting at 110° C. (the level of low-temperature fixability that causes no problem)

D: Offsetting at 120° C. (relatively defective low-temperature fixability)

E: Offsetting at 130° C. (defective low-temperature fixability)

[Bending Resistance of Fixed Images]

An image fixed at a temperature that was 20° C. higher than the temperature of initiation of fixation in the above low-temperature fixability test was rubbed with a lens-cleaning paper (available from Ozu Corporation: DUSPERK-3) while applying a load of 4.9 kPa (50 g/cm$^2$). The decrease of the density between before and after the rubbing was measured as a bending resistance of the fixed image. The evaluation criteria for the bending resistance of the fixed image are as follows.

(Evaluation Criteria)

A: The decrease of the density is less than 5% (particularly excellent bending resistance of fixed images)

B: The decrease of the density is at least 5% to less than 10% (excellent bending resistance of fixed images)

C: The decrease of the density is at least 10% to less than 15% (the level of the bending resistance of fixed images that causes no problem)

D: The decrease of the density is at least 15% to less than 20% (defective bending resistance of fixed images)

E: The decrease of the density is at least 20% (significantly defective bending resistance of fixed images)

[High-Temperature Fixability]

A solid image (amount of toner: 0.9 mg/cm$^2$) was printed on a transfer material at each of various fixation temperatures (180 to 240° C.) and evaluated according to the following criteria. The fixation temperature was measured on the surface of a fixation roller with a non-contact thermometer. The transfer material used was a plain paper (XEROX 4200, letter size, available from XEROX, 75 g/m$^2$).

(Evaluation Criteria)

A: No offsetting at 210° C. (particularly excellent high-temperature fixability)

B: Offsetting at 210° C. (excellent high-temperature fixability)

C: Offsetting at 200° C. (the level of high-temperature fixability that causes no problem)

D: Offsetting at 190° C. (relatively defective high-temperature fixability)

E: Offsetting at 180° C. (defective high-temperature fixability)

[Image Fogging]

Each toner was left to stand under high temperature and high humidity (30° C./80%) for 7 days and then under normal temperature and normal humidity (23° C./60%) for further 3 days to reset the initial charge. Using the toner, 10 sheets of A4 solid white images were output without preliminary rotation under an atmosphere of normal temperature and normal humidity (23° C./60%) and the reflectance of the white solid part of the images was measured. The reflectance of an unused sheet was measured and subtracted from the reflectance of the white solid part of the images to give an image fogging density. The average of the image fogging density for 10 sheets of output images was evaluated according to the following evaluation criteria. The reflectance was measured on "REFLECTOMETER MODEL TC-6DS" (available from Tokyo Denshoku Co., Ltd.). The evaluation was carried out with the glossy paper mode using plain paper (HP Brochure Paper 200 g, Glossy, available from HP, 200 g/m$^2$)

(Evaluation Criteria)

A: Less than 0.5% (particularly excellent charging performance)

B: At least 0.5% to less than 1.0% (excellent charging performance)

C: At least 1.0% to less than 1.5% (the level of the charging performance that causes no problem)

D: At least 1.5% to less than 2.0% (relatively defective charging performance)

E: At least 2.0% (defective charging performance)

[Blocking]

Each toner (5 g) was placed in a 50-cc plastic cup, left to stand under temperature: 55° C./humidity: 10% RH for 3 days and the presence or absence of aggregates was evaluated according to the following criteria.

(Evaluation Criteria)

A: No change (particularly excellent heat-resistant storability)

B: A minute amount of aggregates is produced, which is loosened easily (good heat-resistant storability)

C: A small amount of aggregates is produced, which is loosened with a low impact (the level of the heat-resistant storability that causes no problem)

D: Aggregates are produced and cannot be loosened easily (relatively defective heat-resistant storability)

E: Completely aggregated and solidified in the shape of buttons (defective heat-resistant storability)

Examples 1 to 40

In Examples 1 to 40, the toners 1 to 40 were respectively used and the above evaluations were carried out. The evaluation results are shown in Table 5.

Comparative Examples 1 to 4

In Comparative Examples 1 to 4, the toners 41 to 44 were respectively used and the above evaluations were carried out. The evaluation results are shown in Table 5.

TABLE 5

| | | Durability | Fixation performance | | | Chargeability | |
|---|---|---|---|---|---|---|---|
| | | Number of stripes after durability test | Low-temperature fixability | High-temperature fixability | Bending resistance of fixed images | Image fogging density | Heat resistance Blocking |
| Example 1 | Toner 1 | A (0) | A (90) | A (230) | A (3) | A (0.2) | A |
| Example 2 | Toner 2 | A (0) | B (100) | A (230) | B (6) | A (0.2) | A |
| Example 3 | Toner 3 | B (1) | A (90) | A (220) | A (2) | A (0.3) | B |
| Example 4 | Toner 4 | A (0) | A (85) | A (220) | A (3) | A (0.4) | C |
| Example 5 | Toner 5 | A (0) | C (110) | A (230) | B (8) | A (0.2) | A |
| Example 6 | Toner 6 | A (0) | A (90) | A (230) | A (3) | A (0.2) | A |
| Example 7 | Toner 7 | A (0) | A (90) | A (230) | B (6) | A (0.2) | A |
| Example 8 | Toner 8 | A (0) | A (90) | A (230) | A (3) | A (0.2) | B |
| Example 9 | Toner 9 | A (0) | A (90) | A (220) | A (3) | A (0.2) | A |
| Example 10 | Toner 10 | A (0) | A (95) | A (230) | B (6) | A (0.2) | A |
| Example 11 | Toner 11 | A (0) | A (90) | A (220) | A (3) | A (0.3) | A |
| Example 12 | Toner 12 | A (0) | A (90) | A (230) | A (3) | A (0.2) | A |
| Example 13 | Toner 13 | A (0) | A (90) | A (220) | B (8) | A (0.2) | A |
| Example 14 | Toner 14 | A (0) | B (100) | A (230) | B (7) | A (0.3) | B |
| Example 15 | Toner 15 | C (4) | B (100) | B (210) | C (11) | A (0.2) | A |
| Example 16 | Toner 16 | A (0) | B (100) | B (210) | B (6) | A (0.2) | C |
| Example 17 | Toner 17 | A (0) | B (100) | A (240) | A (2) | A (0.3) | B |
| Example 18 | Toner 18 | B (1) | B (105) | A (230) | A (3) | A (0.2) | B |
| Example 19 | Toner 19 | B (2) | B (105) | A (230) | A (3) | A (0.2) | C |
| Example 20 | Toner 20 | B (2) | B (100) | B (210) | B (9) | A (0.2) | A |
| Example 21 | Toner 21 | A (0) | B (100) | A (230) | A (3) | A (0.2) | A |
| Example 22 | Toner 22 | A (0) | A (90) | A (230) | A (3) | A (0.2) | A |
| Example 23 | Toner 23 | A (0) | A (90) | B (210) | C (11) | B (0.7) | A |
| Example 24 | Toner 24 | A (0) | B (105) | A (240) | A (2) | A (0.2) | A |
| Example 25 | Toner 25 | A (0) | C (110) | A (230) | A (3) | A (0.2) | A |
| Example 26 | Toner 26 | A (0) | C (115) | A (230) | A (3) | A (0.2) | A |
| Example 27 | Toner 27 | B (1) | A (85) | B (210) | A (3) | B (0.8) | C |
| Example 28 | Toner 28 | A (0) | A (90) | A (230) | A (3) | B (0.7) | B |
| Example 29 | Toner 29 | A (0) | B (100) | A (230) | C (13) | A (0.2) | A |
| Example 30 | Toner 30 | A (0) | A (90) | B (210) | A (3) | A (0.2) | A |
| Example 31 | Toner 31 | C (3) | A (85) | B (210) | A (3) | C (1.3) | B |
| Example 32 | Toner 32 | A (0) | A (90) | C (200) | A (4) | A (0.2) | A |
| Example 33 | Toner 33 | A (0) | C (110) | C (200) | B (7) | A (0.2) | B |
| Example 34 | Toner 34 | A (0) | C (110) | A (240) | A (3) | B (0.6) | B |
| Example 35 | Toner 35 | B (1) | A (95) | A (230) | A (3) | A (0.2) | A |
| Example 36 | Toner 36 | B (1) | A (95) | A (220) | A (3) | B (0.8) | A |
| Example 37 | Toner 37 | A (0) | A (90) | A (230) | A (3) | C (1.2) | B |
| Example 38 | Toner 38 | C (3) | A (90) | A (230) | A (3) | A (0.2) | B |
| Example 39 | Toner 39 | B (2) | A (90) | A (230) | A (3) | A (0.2) | B |
| Example 40 | Toner 40 | B (1) | A (90) | A (230) | A (3) | A (0.2) | A |
| Comparative Example 1 | Toner 41 | E (8) | E (130) | D (190) | C (14) | B (0.8) | A |
| Comparative Example 2 | Toner 42 | D (6) | D (120) | B (210) | C (12) | A (0.3) | A |
| Comparative Example 3 | Toner 43 | B (1) | D (120) | A (230) | B (7) | A (0.3) | A |
| Comparative Example 4 | Toner 44 | B (2) | A (80) | B (210) | B (8) | E (2.8) | E |

While the present invention has been described with reference to exemplary embodiments, it is to be understood that the invention is not limited to the disclosed exemplary embodiments. The scope of the following claims is to be accorded the broadest interpretation so as to encompass all such modifications and equivalent structures and functions.

This application claims the benefit of Japanese Patent Application No. 2013-247688, filed Nov. 29, 2013, which is hereby incorporated by reference herein in its entirety.

What is claimed is:

1. A toner comprising a toner particle containing a binder resin, wherein the binder resin contains a block polymer and a styrene-acrylic resin;

the block polymer has a vinyl polymer segment and a crystalline polyester segment;

the polyester segment is a segment produced by condensation polymerization of the following (I), (II) and (III):

(I) a dicarboxylic acid having carboxyl groups at both terminals of a linear alkane having 2 to 16 carbon atoms;

(II) a diol having hydroxy groups at both terminals of a linear alkane having 2 to 16 carbon atoms; and (III) an alkane compound having 3 to 24 carbon atoms, or an alkyl ester, lactone or acid anhydride compound derived from the alkane compound;

the alkane compound is at least one compound selected from the group consisting of the following (a) to (f):

(a) a branch alkanedicarboxylic acid;

(b) a branch alkanediol;

(c) a branch alkane monohydroxy monocarboxylic acid;

(d) a linear alkanedicarboxylic acid at least one of carboxyl groups of which is linked to a moiety other than a terminal;

(e) a linear alkanediol at least one of hydroxy groups of which is linked to a moiety other than a terminal; and (f) a linear alkane monohydroxy monocarboxylic acid at least one of carboxyl group and hydroxy group of which is linked to a moiety other than a terminal;

the block polymer has a melting point (Tm) of 50° C. to 95° C.; and the binder resin contains the block polymer at 2.0% by mass to 50.0% by mass.

2. The toner according to claim 1, wherein the block polymer has a half-width of an endothermic peak, derived from the block polymer, of 4.0° C. to 12.0° C. as observed in differential scanning calorimetric measurement.

3. The toner according to claim 1, wherein the block polymer has a mass ratio between the vinyl polymer segment and the polyester segment ((mass of the vinyl polymer segment): (mass of the polyester segment)) of 30:70 to 80:20.

4. The toner according to claim 3, wherein the block polymer has a mass ratio between the vinyl polymer segment and the polyester segment ((mass of the vinyl polymer segment): (mass of the polyester segment)) of 30:70 to 70:30.

5. The toner according to claim 1, wherein the binder resin contains the block polymer at 6.0% by mass to 50.0% by mass.

6. The toner according to claim 1, wherein the toner particle further contains a wax and satisfies the following formulae (1) and (2):

$$(SPB-1.0)\leq SPC\leq SPB \quad (1)$$

$$(SPW+0.4)\leq SPC \quad (2),$$

where SPB is an SP value of the styrene-acrylic resin; SPC is an SP value of the polyester segment of the block polymer and SPW is an SP value of the wax.

7. The toner according to claim 1, wherein the vinyl polymer segment has a weight-average molecular weight (Mw) of 4000 to 15000.

8. The toner according to claim 1, wherein the block polymer has a weight-average molecular weight (Mw) of 15000 to 40000.

9. The toner according to claim 1, wherein the block polymer has a weight-average molecular weight (Mw) of 20000 to 40000.

10. The toner according to claim 1, wherein the toner particle is produced by a suspension polymerization method.

* * * * *